US011472013B2

(12) United States Patent
Akiba et al.

(10) Patent No.: US 11,472,013 B2
(45) Date of Patent: Oct. 18, 2022

(54) DRIVING TOOL

(71) Applicant: MAKITA CORPORATION, Anjo (JP)

(72) Inventors: Yoshitaka Akiba, Anjo (JP); Kazusa Fukuda, Anjo (JP)

(73) Assignee: MAKITA CORPORATION, Anjo (JP)

( * ) Notice: Subject to any disclaimer, the term of this patent is extended or adjusted under 35 U.S.C. 154(b) by 295 days.

(21) Appl. No.: 16/757,319

(22) PCT Filed: Oct. 3, 2018

(86) PCT No.: PCT/JP2018/037114

§ 371 (c)(1),
(2) Date: Apr. 17, 2020

(87) PCT Pub. No.: WO2019/078008

PCT Pub. Date: Apr. 25, 2019

(65) Prior Publication Data

US 2020/0298387 A1 Sep. 24, 2020

(30) Foreign Application Priority Data

Oct. 17, 2017 (JP) ..... JP2017-201298

(51) Int. Cl.
*B25C 1/06* (2006.01)
*B25C 1/00* (2006.01)

(52) U.S. Cl.
CPC ..... *B25C 1/06* (2013.01); *B25C 1/008* (2013.01)

(58) Field of Classification Search
CPC ..... B25C 1/06; B25C 1/008
See application file for complete search history.

(56) References Cited

U.S. PATENT DOCUMENTS 4,189,080 A 2/1980 Smith et al.
4,290,493 A 9/1981 Smith et al.
(Continued)

FOREIGN PATENT DOCUMENTS

DE 10 2013 208 300 A1 11/2014
JP S54-115485 A 9/1979
(Continued)

OTHER PUBLICATIONS

Dec. 4, 2018 International Search Report issued in International Patent Application No. PCT/JP2018/037114.
(Continued)

*Primary Examiner* — Anna K Kinsaul
*Assistant Examiner* — Lucas E. A. Palmer
(74) *Attorney, Agent, or Firm* — Oliff PLC

(57) ABSTRACT

A driving tool includes a tool body, a flywheel, a driver and a pressing mechanism. The pressing mechanism is disposed on a side opposite to the flywheel across the driver in a facing direction in which the flywheel and the driver face each other. The pressing mechanism includes a spring mechanism and a pressing roller. The spring mechanism includes a first spring part and a second spring part and is configured to be displaced along with forward movement of the driver. The pressing roller is configured to press the driver toward the flywheel in the facing direction by a biasing force of the spring mechanism in a process of the forward movement of the driver, to thereby enable transmission of the rotational energy to the driver. A spring constant of the whole spring mechanism varies according to an amount of displacement of the whole spring mechanism.

19 Claims, 18 Drawing Sheets

(56) References Cited

U.S. PATENT DOCUMENTS

| | | | | |
|---|---|---|---|---|
| 4,721,170 | A | 1/1988 | Rees | |
| 7,997,467 | B2 * | 8/2011 | Hirabayashi | B25C 1/06 227/156 |
| 8,136,606 | B2 * | 3/2012 | Krondorfer | B25C 1/06 173/1 |
| 10,926,385 | B2 * | 2/2021 | Myers | B25B 21/002 |
| 2006/0261125 | A1 * | 11/2006 | Schiestl | B25C 1/06 227/133 |
| 2006/0283910 | A1 | 12/2006 | Schiestl et al. | |
| 2008/0257933 | A1 * | 10/2008 | Takahashi | B25C 1/06 227/129 |
| 2009/0032567 | A1 * | 2/2009 | Liang | B25C 1/06 227/131 |
| 2009/0194573 | A1 | 8/2009 | Liang et al. | |
| 2009/0289094 | A1 * | 11/2009 | Schiestl | B25C 1/008 227/8 |
| 2009/0321495 | A1 | 12/2009 | Hirabayashi et al. | |
| 2010/0116863 | A1 * | 5/2010 | Suda | B25C 1/06 227/8 |
| 2011/0094847 | A1 * | 4/2011 | Hirabayashi | B25C 1/06 192/105 R |
| 2014/0076951 | A1 * | 3/2014 | Brendel | B25C 1/06 227/8 |
| 2014/0076952 | A1 * | 3/2014 | Garber | B25C 1/06 227/129 |
| 2014/0088753 | A1 * | 3/2014 | Lim | B25F 5/021 700/168 |
| 2014/0097223 | A1 * | 4/2014 | Baron | B25C 1/06 227/129 |
| 2018/0001454 | A1 * | 1/2018 | Jaskot | B25C 1/06 |
| 2018/0001455 | A1 * | 1/2018 | Meyer | B25C 1/008 |
| 2018/0001456 | A1 * | 1/2018 | Garber | B25C 1/06 |
| 2018/0015600 | A1 * | 1/2018 | Akiba | B25C 1/06 |
| 2019/0366527 | A1 * | 12/2019 | Akiba | B25C 5/15 |
| 2020/0039044 | A1 * | 2/2020 | Akiba | B25C 1/06 |
| 2020/0276691 | A1 * | 9/2020 | Akiba | B25C 1/008 |
| 2020/0306941 | A1 * | 10/2020 | Akiba | B25C 1/04 |
| 2020/0391366 | A1 * | 12/2020 | Akiba | B25F 5/001 |

FOREIGN PATENT DOCUMENTS

| | | | |
|---|---|---|---|
| JP | S56-039340 | A | 4/1981 |
| JP | S62-114886 | A | 5/1987 |
| JP | 2006-130592 | A | 5/2006 |
| JP | 2006-346855 | A | 12/2006 |
| JP | 2008-073805 | A | 4/2008 |
| WO | 2014/180777 | A1 | 11/2014 |

OTHER PUBLICATIONS

Apr. 21, 2020 International Preliminary Report on Patentability issued in International Patent Application No. PCT/JP2018/037114.

* cited by examiner

DRIVING TOOL

TECHNICAL FIELD

The present invention relates to a driving tool which is configured to eject a fastener from an ejection outlet to drive the fastener into a workpiece.

BACKGROUND

A driving tool is known which is configured to drive out a fastener such as a nail by linearly moving a driver. For example, in a driving tool disclosed in U.S. Unexamined Patent Application Publication No. 2014/0097223, a follower arm is pulled when a solenoid is actuated. A cylindrical coil spring is compressed along with movement of the follower arm. Then, a roller supported by a roller assembly presses a driver by a biasing force of the cylindrical coil spring and presses the driver against a flywheel. Thus, the driver and the flywheel are frictionally engaged with each other and rotational energy of the flywheel is transmitted to the driver. The driver is pushed out forward along a specified driving axis and drives out a nail from a nose part.

SUMMARY

Technical Problem

In a driving tool configured to transmit rotational energy of a flywheel to a driver to move the driver, if the load of a spring is too large when the driver is frictionally engaged with the flywheel, the driver may be flicked by the flywheel. On the other hand, it is preferable to suppress slip of the driver relative to the flywheel as much as possible when driving a nail with the driver. Specifically, a load for strongly pressing the driver against the flywheel is required. In a pressing mechanism of the above-described driving tool, however, it may be difficult to appropriately adjust the load over a moving process of the driver.

Accordingly, considering such circumstances, it is an object of the present invention to provide an improved technique for a pressing mechanism for pressing a driver, in a driving tool for driving a fastener into a workpiece by ejecting the fastener from an ejection outlet with the driver.

Solution to Problem

In one aspect of the present invention, a driving tool is provided which is configured to eject a fastener from an ejection outlet to drive the fastener into a workpiece. This driving tool includes a tool body, a flywheel, a driver and a pressing mechanism.

The tool body extends in a front-rear direction of the driving tool and has the ejection outlet on its front end. The flywheel is housed in the tool body and configured to be rotationally driven. The driver is disposed to face an outer periphery of the flywheel. Further, the driver is configured to linearly move forward along an operation line extending in the front-rear direction by rotational energy transmitted from the flywheel to thereby strike and drive the fastener into the workpiece.

The pressing mechanism is disposed on a side opposite to the flywheel across the driver in a facing direction in which the flywheel and the driver face each other. Further, the pressing mechanism includes a spring mechanism and a pressing roller. The spring mechanism includes a first spring part and a second spring part. Each of the first spring part and the second spring part includes at least one spring. In other words, each of the first spring part and the second spring part may include a single spring, or may include a combined spring including a plurality of springs. Further, the spring mechanism is configured to be displaced along with forward movement of the driver. The pressing roller is disposed to face the driver. Further, the pressing roller is configured to press the driver toward the flywheel in the facing direction by a biasing force of the spring mechanism in a process of the forward movement of the driver, to thereby enable transmission of the rotational energy to the driver. The spring constant of the whole spring mechanism varies according to an amount of displacement of the whole spring mechanism.

In the driving tool of the present aspect, the pressing mechanism includes the spring mechanism that includes the first and second spring parts (that is, at least two springs), and the pressing roller that is configured to press the driver by the biasing force of the spring mechanism. Further, the spring constant of the whole spring mechanism varies according to the amount of displacement of the whole spring mechanism. In other words, unlike a single cylindrical coil spring, there is no proportional relationship between the amount of displacement of the whole spring mechanism and the load (a biasing force, a spring force) of the whole spring mechanism. In other words, the spring mechanism has a nonlinear characteristic. Therefore, with the pressing mechanism of the present aspect, the load for the pressing roller to press the driver can be significantly changed as the spring constant varies in the moving process of the driver. It is noted that it is preferred that the driver is relatively softly pressed in an early stage of the moving process, and thereafter more strongly pressed. Therefore, it is preferred that the spring constant of the whole spring mechanism becomes larger when the amount of displacement of the whole spring mechanism increases along with the movement of the driver. For example, the spring constant may become larger when the amount of displacement exceeds a specified threshold, or the spring constant may become larger as the amount of displacement increases (in other words, the spring constant may gradually increase).

It is noted that the rotational energy of the flywheel may be transmitted from the flywheel to the driver directly, or may be transmitted to the driver via a transmitting member that is disposed between the flywheel and the driver. Further, the manner that the spring mechanism is "displaced along with forward movement of the driver" include not only the manner that it is "displaced over the whole process of forward movement of the driver", but also the manner that it is "displaced in part of the process of forward movement of the driver". The manner that the pressing roller "presses the driver in a process of the forward movement of the driver" includes not only the manner that it "presses the driver over the whole process of the forward movement of the driver" but also the manner that it "presses the driver in part of the process of the forward movement of the driver".

In one aspect of the present invention, the first spring part and the second spring part may be arranged in series. Further, in one aspect of the present invention, the first spring part and the second spring part may have different spring constants from each other. According to these aspects, the spring mechanism having a nonlinear characteristic can be easily realized.

In one aspect of the present invention, the pressing mechanism may include an interposed member that is disposed between the first spring part and the second spring part and that abuts an end portion of the first spring part and an end portion of the second spring part. The first and second spring parts having different spring constants from each other may often have different diameters from each other. According to the present aspect, however, such first and second spring parts may be appropriately connected to each other via the interposed member disposed therebetween.

In one aspect of the present invention, the second spring part may have a larger spring constant than the first spring part. Additionally, the pressing mechanism may include an upper-limit-defining part configured to define the amount of displacement of the first spring part. According to the present aspect, while the whole spring mechanism is displaced, the first spring part, which has a smaller spring constant (which is softer) than the second spring part, can be significantly displaced earlier than the second spring part. When the amount of displacement of the first spring part reaches the upper limit, only the second spring part having a larger spring constant than the first spring part can be displaced, so that the rate of increase in the biasing force relative to the amount of displacement becomes higher. By defining the amount of displacement of the first spring part using the upper-limit-defining part, switching can be reliably and easily performed in the moving process of the driver, from a section in which a relatively small load is generated to a section in which a relatively large load is generated.

In one aspect of the present invention, the upper-limit-defining part may include an interposed member that is disposed between the first spring part and the second spring part and that abuts on an end portion of the first spring part and an end portion of the second spring part, and an abutment member that is configured to abut on the interposed member to thereby define the amount of displacement of the first spring part. The first and second spring parts having different spring constants from each other may often have different diameters from each other. According to the present aspect, however, the upper-limit-defining part can be provided with the interposed member appropriately connecting the first and second spring parts.

In one aspect of the present invention, the at least one spring of the first spring part and the at least one spring of the second spring part each may comprise a disc spring. According to the present aspect, the spring mechanism can be realized which is capable of generating a relatively large load while suppressing size increase.

In one aspect of the present invention, the spring mechanism may have a nonlinear characteristic that the spring constant becomes larger when the amount of displacement exceeds a specified threshold.

In one aspect of the present invention, the first spring part may have a smaller spring constant than the second spring part. The spring mechanism may be configured such that the first spring part and the second spring part are displaced until the amount of displacement reaches the threshold, and that only the second spring part is displaced after the amount of displacement exceeds the threshold.

In one aspect of the present invention, the spring mechanism may be configured such that, after the driver reaches a transmitting position in which the transmission of the rotational energy to the driver is enabled, the spring constant of the whole spring mechanism becomes larger than when the driver moves from an initial position to the transmitting position.

DESCRIPTION OF EMBODIMENTS

An embodiment of the present invention is now described with reference to the drawings. In the present embodiment, a nailing machine 1 is described as an example of a driving tool, with reference to FIGS. 1 to 18. The nailing machine 1 is a tool that is capable of performing a nail-driving operation of driving a nail 101 into a workpiece (such as wood) 100 by linearly driving out the nail 101 from an ejection outlet 123.

Figure 1:
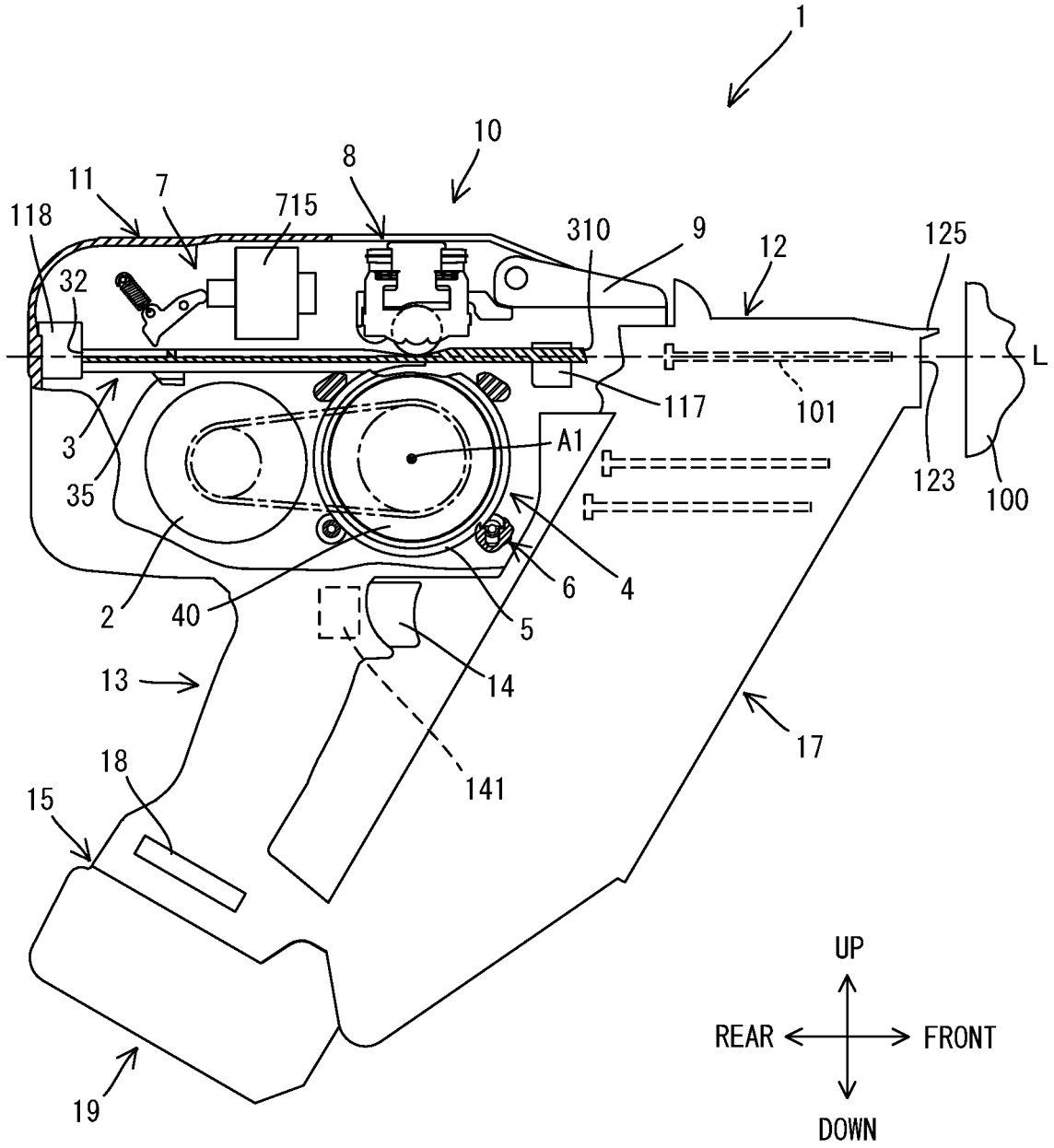
FIG. 1 is an explanatory drawing showing the overall structure of a nailing machine when a driver is located in an initial position.

First, the general structure of the nailing machine 1 is described with reference to FIG. 1. As shown in FIG. 1, an outer shell of the nailing machine 1 of the present embodiment is mainly formed by a tool body 10, a handle 13 and a magazine 17.

The tool body 10 includes a body housing 11 and a nose part 12. The body housing 11 houses a motor 2, a driver 3, a driver-driving mechanism 4 and a return mechanism (not shown). The driver 3 is disposed such that the driver 3 is linearly movable along a specified operation line L. The driver-driving mechanism 4 is configured to drive out the nail 101 from the nailing machine 1 by moving the driver 3 along the operation line L. The return mechanism is configured to return the driver 3 to an initial position after the driver 3 drives out the nail 101. The nose part 12 is connected to one end of the body housing 11 in an extending direction of the operation line L (hereinafter simply referred to as an operation-line-L direction). The nose part 12 has a driver passage (not shown) which extends through the nose part 12 in the operation-line-L direction. One end of the driver passage is open to the inside of the body housing 11. The other end of the driver passage is open to the outside of the nailing machine 1, as an ejection outlet 123 through which the nail 101 is driven out. A contact arm 125, which is configured to be extendable and retractable in the operation-line-L direction, is held adjacent to the ejection outlet 123 on the nose part 1. Further, a contact-arm switch (not shown), which is configured to be normally kept in an OFF state while being turned ON when the contact arm 125 is pressed, is disposed within the body housing 11.

The handle 13 extends in a direction that intersects the operation line L, from a central portion of the body housing 11 in the operation-line-L direction. The handle 13 is a portion to be held by a user. A trigger 14, which may be depressed by a user, is provided in a base end portion (an end portion connected to the body housing 11) of the handle 13. A trigger switch 141, which is normally kept in an OFF state and which is turned ON when the trigger 14 is depressed, is disposed within the handle 13. Further, a battery-mounting part 15 having terminals is provided on a distal end portion (an end portion opposite to the base end portion) of the handle 13. A rechargeable battery 19 is removably mounted to the battery-mounting part 15. A controller 18 for controlling operation of the nailing machine 1 is disposed inside the distal end portion of the handle 13. The contact-arm switch, the trigger switch 141, the motor 2 and a solenoid 715 etc. are electrically connected to the controller 18.

The magazine 17 is configured to be loaded with a plurality of nails 101 and mounted to the nose part 12. The nails 101 loaded in the magazine 17 may be fed one by one to the driver passage by a nail-feeding mechanism (not shown). The structure of the magazine 17 is well known and therefore its description is omitted.

The detailed structure of the nailing machine 1 is now described. In the following description, for convenience sake, the operation-line-L direction of the driver 3 (a left-right direction in FIG. 1) is defined as a front-rear direction of the nailing machine 1, and in the front-rear direction, the ejection outlet 123 side (the right side in FIG. 1) is defined as a front side of the nailing machine 1, while its opposite side (the left side in FIG. 1) is defined as a rear side. Further, a direction (an up-down direction in FIG. 1) which is orthogonal to the operation line L and which corresponds to the extending direction of the handle 13 is defined as an up-down direction of the nailing machine 1, and in the up-down direction, the side (an upper side in FIG. 1) on which the handle 13 is connected to the tool body 10 (the body housing 11) is defined as an upper side, while the side (a lower side in FIG. 1) of the distal end portion (the end portion on which the battery 19 is mounted) of the handle 13 is defined as a lower side. Further, a direction which is orthogonal to the front-rear direction and to the up-down direction is defined as a left-right direction.

The motor 2, the driver 3 and the driver-driving mechanism 4 which are housed within the body housing 11 are first described in this order. It is noted that, in FIGS. 1 and 2, for convenience of explanation, a ring member 5 described below is shown partially cutaway.

Figure 2:
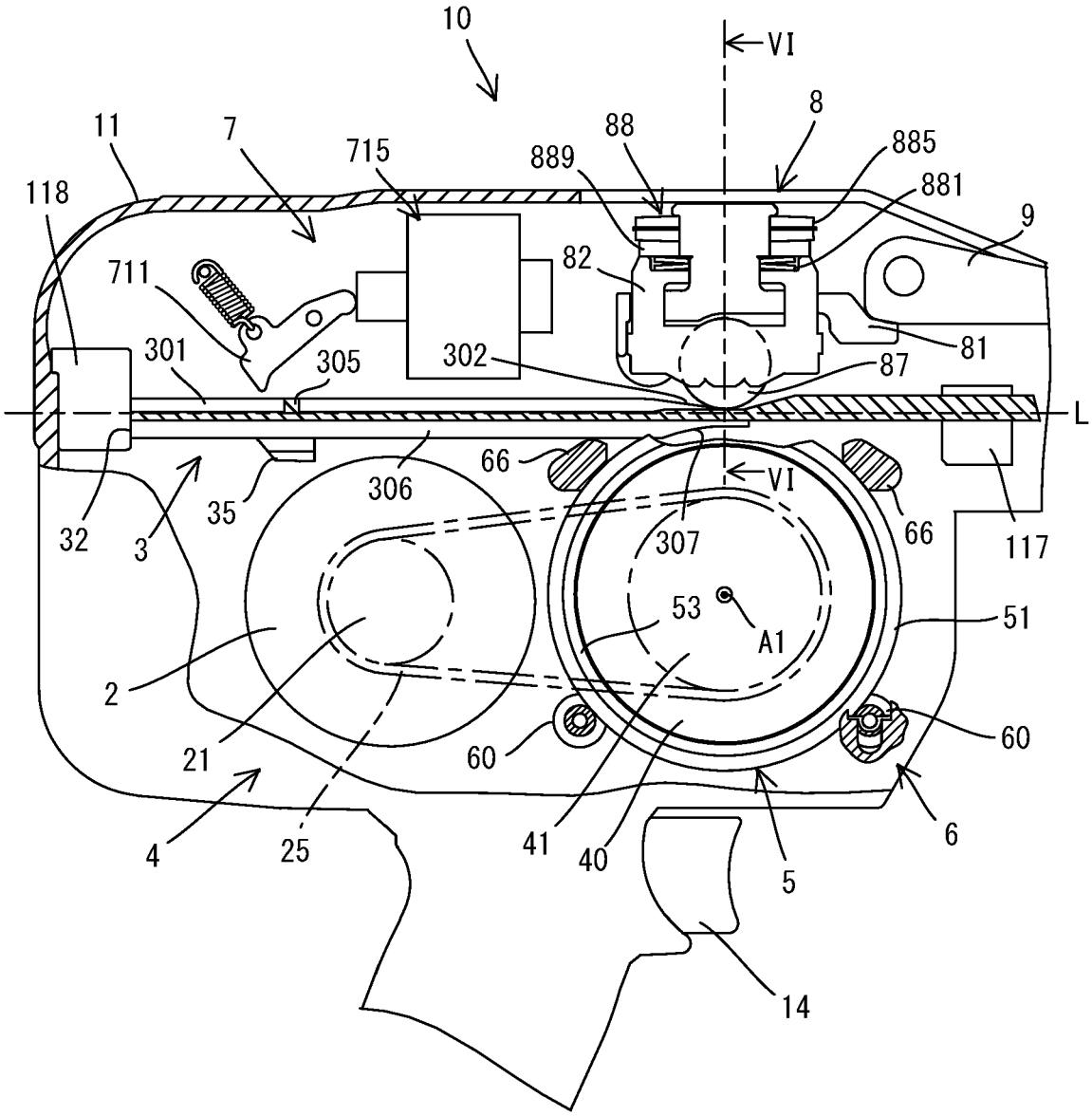
FIG. 2 is a partial, enlarged view of FIG. 1.

The motor 2 is described. As shown in FIG. 2, the motor 2 is housed in a rear lower portion of the body housing 11. Further, the motor 2 is arranged such that a rotation axis of an output shaft (not shown) extends in the left-right direction, perpendicular to the operation line L. In the present embodiment, a compact and high-output brushless DC motor is adopted as the motor 2. A pulley 21, which rotates together with the output shat, is connected to the output shaft of the motor 2. It is noted that, in the present embodiment, when the contact arm 125 (see FIG. 1) of the nose part 12 is pressed against the workpiece 100 and the contact-arm switch is turned on, the controller 18 controls to supply current from the battery 19 to the motor 2 to start driving of the motor 2.

Figure 3:
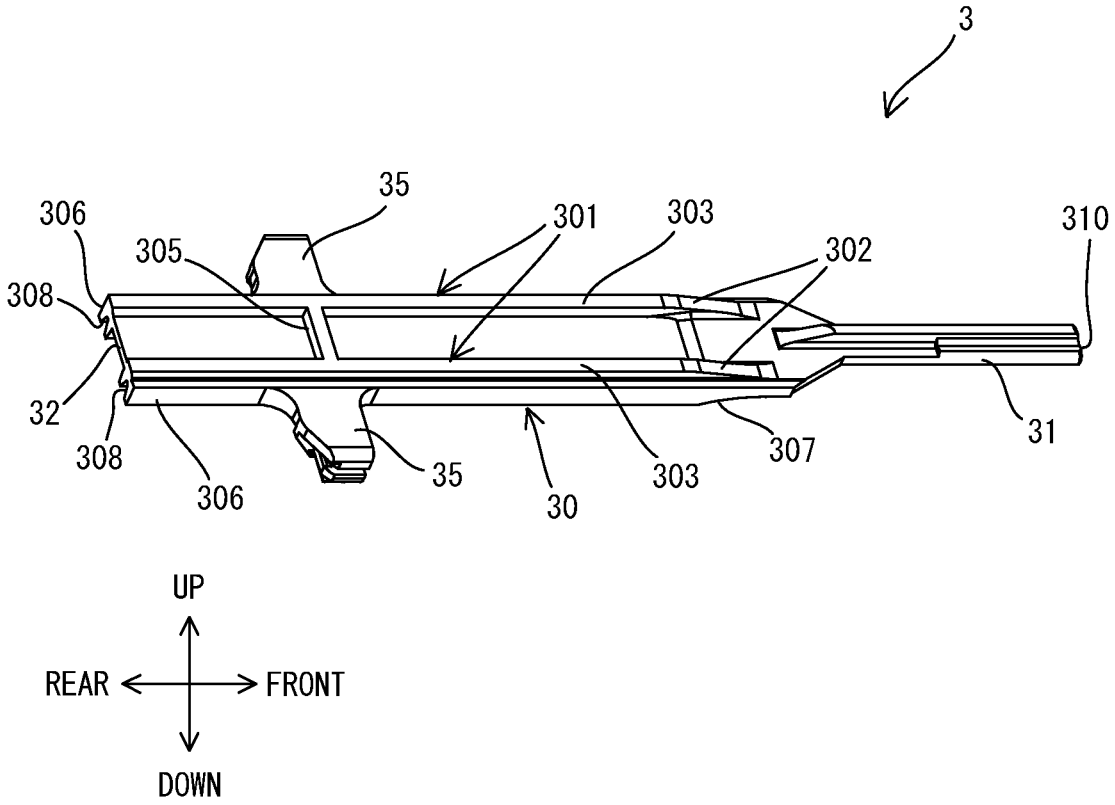
FIG. 3 is a perspective view of the driver.

The driver 3 is described. As shown in FIG. 3, the driver 3 is an elongate member formed symmetrically relative to its longitudinal axis. The driver 3 includes a body part 30, a striking part 31 and a pair of arm parts 35. The body part 30 is a portion which has a generally rectangular plate-like shape as a whole. The striking part 31 is a portion which extends forward from a front end of the body part 30, and has a smaller width than the body part 30 in the left-right direction. The pair of arm parts 35 protrude to the left and right from a rear portion of the body part 30.

The body part 30 is a portion to be pressed by pressing rollers 87 (see FIG. 2) described below and to be frictionally engaged with the ring members 5 (see FIG. 2). The body part 30 has a pair of roller-abutting parts 301, a lever-abutting part 305 and a pair of ring-engagement parts 306, which are now described in this order.

The pair of roller-abutting parts 301 are integrally formed with the body part 30, such that the roller-abutting parts 301 protrude upward from an upper surface of the body part 30 and extend in the front-rear direction along left and right edges of the body part 30. A surface formed on a protruding end (an upper end) of each roller-abutting part 301 is formed as an abutment surface to abut on an outer peripheral surface of the pressing roller 87. Further, a front end portion of the roller-abutting part 301 is formed as an inclined part 302 which has a height (a thickness in the up-down direction) gradually increasing toward the rear. On the other hand, a portion of the roller-abutting part 301 which extends rearward from the inclined part 302 is formed as a straight part 303 having a constant height. The lever-abutting part 305 is formed to protrude upward from the upper surface of the body part 30 and extends in the left-right direction so as to connect the left and right roller-abutting parts 301 (the straight parts 303) in the rear portion of the body part 30. A push-out lever 711 described below may abut on the lever-abutting part 305 from the rear.

The pair of ring-engagement parts 306 are integrally formed with the body part 30, such that the ring-engagement parts 306 protrude downward from a lower surface of the body part 30 and extend in the front-rear direction along the left and right edges of the body part 30. A front end portion of each ring-engagement part 306 is formed as an inclined part 307 which has a height (the up-down direction) gradually increasing toward the rear. The ring-engagement parts 306 have respective engagement grooves 308 which are engageable with outer-peripheral engagement parts 51 of two ring members 5, which will be described below. Each of the engagement grooves 308 is recessed upward from a protruding end of the ring-engagement part 306. Further, each of the engagement grooves 308 extends over the whole length of the ring-engagement part 306 in the front-rear direction. Further, the engagement groove 308 is formed such that its width in the left-right direction decreases toward the top (in other words, such that left and right wall surfaces of the ring-engagement part 306 which define the engagement groove 308 get closer to each other toward the top) (see FIG. 6). Engagement between the driver 3 and the ring members 5 will be described in detail below.

A rear end 32 of the body part 30 defines a rear end of the driver 3. The rear end 32 is a portion which prevents the driver 3 from further moving rearward by abutting on a rear stopper part 118 (see FIG. 2) fixed within a rear end portion of the body housing 11. A front end 310 of the striking part 31 defines a front end of the driver 3. The front end 310 is a portion which strikes a head of the nail 101 (see FIG. 1) to drive the nail 101 forward into the workpiece 100.

The pair of arm parts 35 protrude to the left and right from the body part 30. The arm parts 35 are portions which prevent the driver 3 from further moving forward by abutting on a pair of front stopper parts 117 (see FIG. 2) fixed within a front end portion of the body housing 11. Although not described in detail and not shown, the arm parts 35 are connected to the return mechanism by a connecting member. In the nailing machine 1 of the present embodiment, any known structure may be adopted as the return mechanism. For example, the return mechanism may be configured to return the driver 3 to the initial position along the operation line L, via the connecting member, by elastic force of an elastic member (such as a compression coil spring and a torsion coil spring) after the driver 3 is moved forward to a nail-driving position.

The driver 3 having the above-described structure is arranged such that its longitudinal axis extends along the operation line L in the front-rear direction of the nailing machine 1. Further, the driver 3 is held to be movable between the initial position and the nail-driving position along the operation line L (in other words, in the front-rear direction of the nailing machine 1 or in the longitudinal direction of the driver 3).

Figure 4:
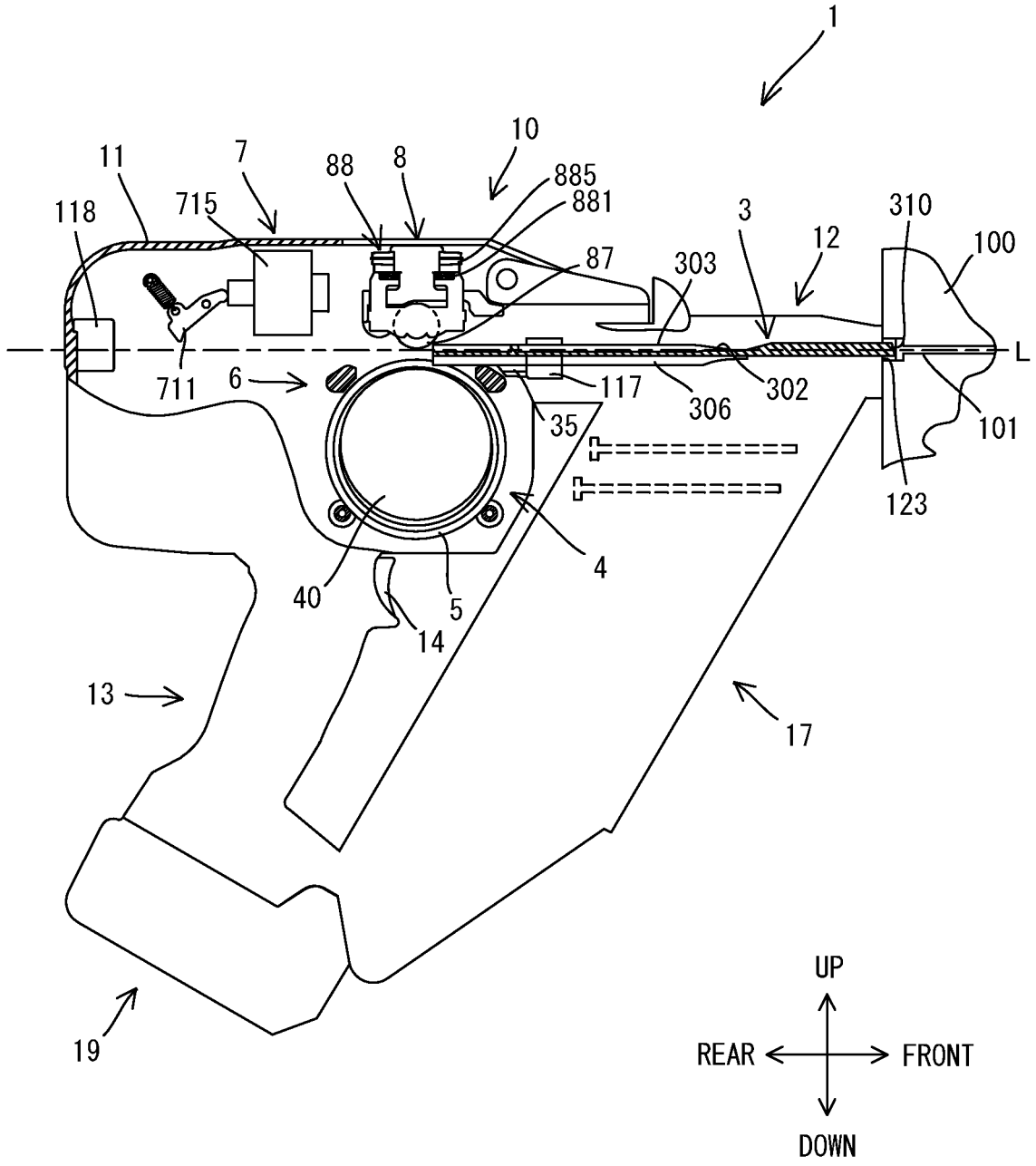
FIG. 4 is an explanatory drawing showing the overall structure of the nailing machine when the driver is located in a nail-driving position.

The initial position and the nail-driving position of the driver 3 are now described with reference to FIGS. 1 and 4. The initial position is a position where the driver 3 is held in a state that the driver-driving mechanism 4 is not actuated (hereinafter referred to as an initial state). In the present embodiment, as shown in FIG. 1, the initial position of the driver 3 is set to a position where the rear end 32 of the driver 3 abuts on the rear stopper part 118. The nail-driving position is a position where the driver 3 drives the nail 101 into a workpiece after being moved forward by the driver-driving mechanism 4. In the present embodiment, as shown in FIG. 4, the nail-driving position of the driver 3 is set to a position where the front end 310 of the driver 3 slightly protrudes from the ejection outlet 123. The nail-driving position is also a position where front ends of the arm parts 35 abut on the front stopper parts 117 from the rear. With the above-described arrangement, in the present embodiment, the initial position and the nail-driving position can also be respectively referred to as a rearmost position and a foremost position which define a movable range of the driver 3 which moves along the operation line L.

The detailed structure of the driver-driving mechanism 4 is described below. In the present embodiment, as shown in FIG. 2, the driver-driving mechanism 4 includes a flywheel 40, two ring members 5, a holding mechanism 6, an actuating mechanism 7 and a pressing mechanism 8. The structures of these components are now described in detail in this order.

The flywheel 40 is described. As shown in FIG. 2, the flywheel 40 has a cylindrical shape and is rotatably supported in front of the motor 2 within the body housing 11. The flywheel 40 is rotationally driven around a rotation axis A1 by the motor 2. The rotation axis A1 extends in the left-right direction which is orthogonal to the operation line L of the driver 3 and parallel to the rotation axis of the motor 2. A pulley 41 is connected to a support shaft of the flywheel 40 and rotates together with the support shaft and the flywheel 40. A belt 25 is looped over the pulleys 21 and 41. When the motor 2 is driven, rotation of the output shaft of the motor 2 is transmitted to the flywheel 40 via the belt 25, and the flywheel 40 rotates clockwise as viewed in FIG. 2.

Figure 5:
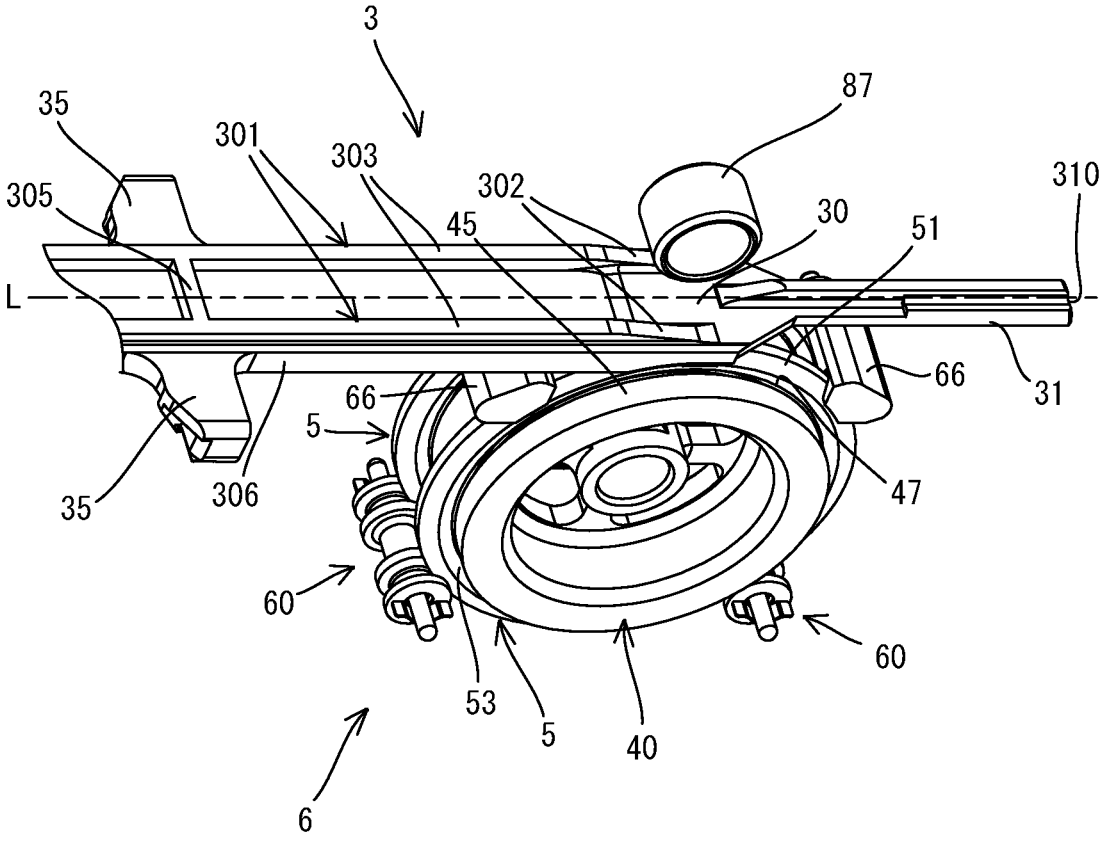
FIG. 5 is a perspective view showing a flywheel, a ring member, a holding mechanism and a pressing roller when the driver is located in the initial position.
Figure 6:
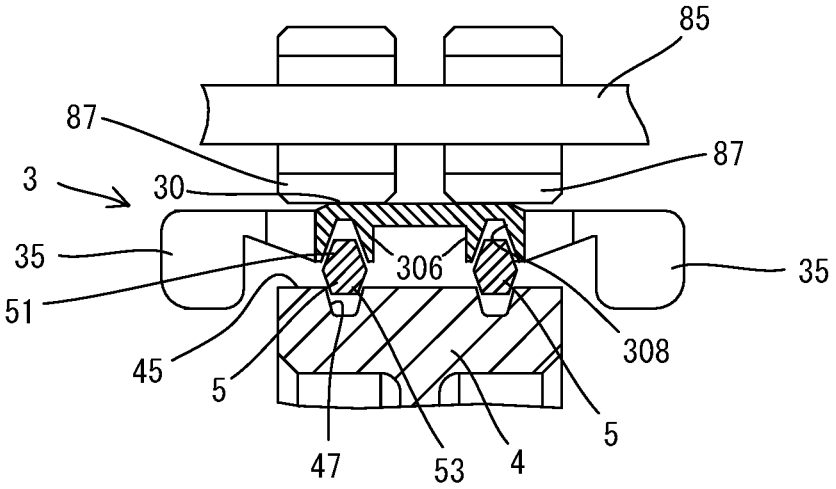
FIG. 6 is a sectional view taken along line VI-VI in FIG. 2 (except that, as for a pressing mechanism, only the pressing rollers and a support shaft are shown).

As shown in FIGS. 5 and 6, a pair of engagement grooves 47 are formed in an outer periphery 45 of the flywheel 40 to extend over the whole circumference of the flywheel 40. The ring members 5 are engageable with the engagement grooves 47. Each of the engagement grooves 47 is formed such that its width in the left-right direction decreases toward the inner side in a radial direction of the flywheel 40.

The ring members 5 are described. As shown in FIG. 5, each of the ring members 5 has a ring-like shape having a larger diameter than the flywheel 40. In the present embodiment, the inner diameter of the ring member 5 is set to be larger than the outer diameter of the flywheel 40 (strictly, the diameter from the rotation axis A1 of the flywheel 40 to the bottom of the engagement groove 47). The two ring members 5 are disposed radially outward of the flywheel 40 relative to the pair of engagement grooves 47 formed in the outer periphery 45 of the flywheel 40. In the present embodiment, each of the two ring members 5 is held by the holding mechanism 6 described below so as to be movable between a separate position where it is apart from the outer periphery 45 (more specifically, from the engagement grooves 47) of the flywheel 40 and a contact position where it is in partial contact with the outer periphery 45 (the engagement grooves 47).

Each of the ring members 5 is a transmitting member for transmitting the rotational energy of the flywheel 40 to the driver 3, and configured to be frictionally engaged with the driver 3 and the flywheel 40. Specifically, as shown in FIG. 6, the outer-peripheral engagement part 51, which is engageable with the engagement groove 308 of the driver 3, is formed in an outer periphery of the ring member 5. More specifically, the outer-peripheral engagement part 51 is formed as a protrusion protruding outward in the radial direction of the ring member 5. Further, an inner-peripheral engagement part 53, which is engageable with the engagement groove 47 of the flywheel 40, is formed in an inner periphery of the ring member 5. The inner-peripheral engagement part 53 is formed as a protrusion protruding inward in the radial direction of the ring member 5.

It is noted that the ring member 5 has a generally hexagonal section in the radial direction. The outer-peripheral engagement part 51 is formed such that its thickness decreases toward the outer side in the radial direction of the ring member 5, and the inner-peripheral engagement part 53 is formed such that its thickness in the axial direction decreases toward the inner side in the radial direction of the ring member 5. Thus, both the outer-peripheral engagement part 51 and the inner-peripheral engagement part 53 are formed to have a section tapered toward their respective distal ends. Engagement of the ring members 5 with the driver 3 and the flywheel 40 will be described in detail below.

The holding mechanism 6 is described. The holding mechanism 6 is configured to hold the ring members 5 such that the ring members 5 can move between their respective separate positions and the contact positions. As shown in FIGS. 2 and 5, the holding mechanism 6 of the present embodiment includes a pair of ring-biasing parts 60 and a pair of stoppers 66. The pair of ring-biasing parts 60 are respectively disposed diagonally forward and downward of the ring members 5 and diagonally rearward and downward of the ring members 5. The pair of ring-biasing parts 60 rotatably support the ring members 5 while biasing the ring members 5 upward from below by flat springs. The pair of stoppers 66 are disposed below the driver 3 and respectively diagonally forward and upward of the ring members 5 and diagonally rearward and upward of the ring members 5. The pair of stoppers 66 are configured to restrict upward movement of the ring members 5 while allowing the ring members 5 to rotate.

The manner of holding the ring members 5 by the holding mechanism 6 is now described. As shown in FIG. 5, in the initial state, the ring-biasing parts 60 abut on the ring members 5 from below to bias the ring members 5 upward. Further, the stoppers 66 abut on the ring members 5 from above to prevent the ring members 5 from further moving upward. Thus, as shown in FIG. 6, the ring members 5 are held in their separate positions apart from the outer periphery 45 (the engagement grooves 47) over the whole circumference of the flywheel 40. Although only an upper end portion of the flywheel 40 is shown, the ring members 5 are similarly held apart from the outer periphery 45 (more specifically, the engagement grooves 47) of the flywheel 40 over the whole circumference of the flywheel 40. When the driver 3 is moved forward by the actuating mechanism 7 and presses the ring members 5 downward, the ring members 5 are moved downward against the biasing force of the ring-biasing parts 60 and held in their contact positions where the ring members 5 are in contact with the outer periphery 45 (the engagement grooves 47) on an upper portion of the flywheel 40 (see FIG. 13), which will be described in further detail below.

The actuating mechanism 7 is described. As shown in FIG. 2, the actuating mechanism 7 is disposed above the driver 3 and rearward of the flywheel 40 within the body housing 11. The actuating mechanism 7 is configured to move the driver 3 along the operation line L from the initial position to a transmitting position described below. In the present embodiment, the actuating mechanism 7 mainly includes the solenoid 715 and the push-out lever 711. The solenoid 715 is actuated by the controller 18 (see FIG. 1) when the trigger switch 141 (see FIG. 1) is switched on. The push-out lever 711 is arranged to be rotatable around a rotation axis extending in the left-right direction and turned along with actuation of the solenoid 715. In the initial state, a tip end portion of the push-out lever 711 is located diagonally upward and rearward of the lever-abutting part 305 of the lever 3. When the solenoid 715 is actuated, the push-out lever 711 is turned in a counterclockwise direction as viewed in FIG. 2. The tip end portion of the push-out lever 711 pushes the lever-abutting part 305 forward from the rear and thus moves the driver 3 forward (see FIG. 12). Operations of the driver 3 and the driver-driving mechanism 4 will be described in detail below.

The pressing mechanism 8 is described. As shown in FIG. 2, the pressing mechanism 8 is disposed within the body housing 11 on the side opposite to the flywheel 40 across the driver 3 in a facing direction (up-down direction) in which the flywheel 40 and the driver 3 face each other. In other words, the pressing mechanism 8 is disposed such that the pressing mechanism 8 faces the driver 3 from above. The pressing mechanism 8 is configured to press the driver 3 toward the ring members 5 (that is, in a direction toward the flywheel 40) in the process that the driver 3 moves forward from the initial position, to thereby enable transmission of the rotational energy of the flywheel 40 to the driver 3 via the ring members 5.

As shown in FIGS. 7 to 10, in the present embodiment, the pressing mechanism 8 mainly includes a base member 81, a roller holder 82, pressing rollers 87 and a spring mechanism 88. Detailed structures of these components are now described.

Figure 7:
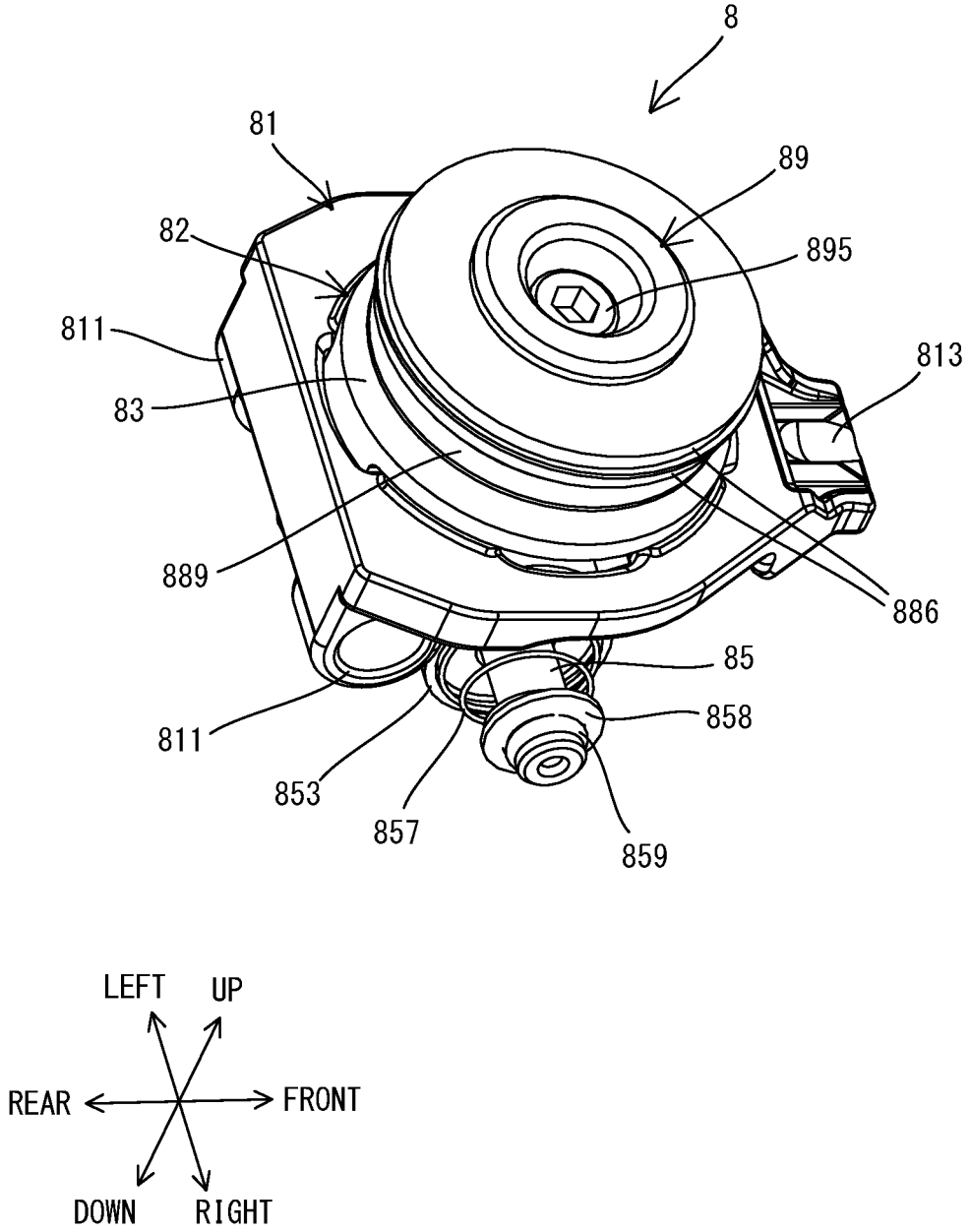
FIG. 7 is a perspective view of the pressing mechanism.
Figure 8:
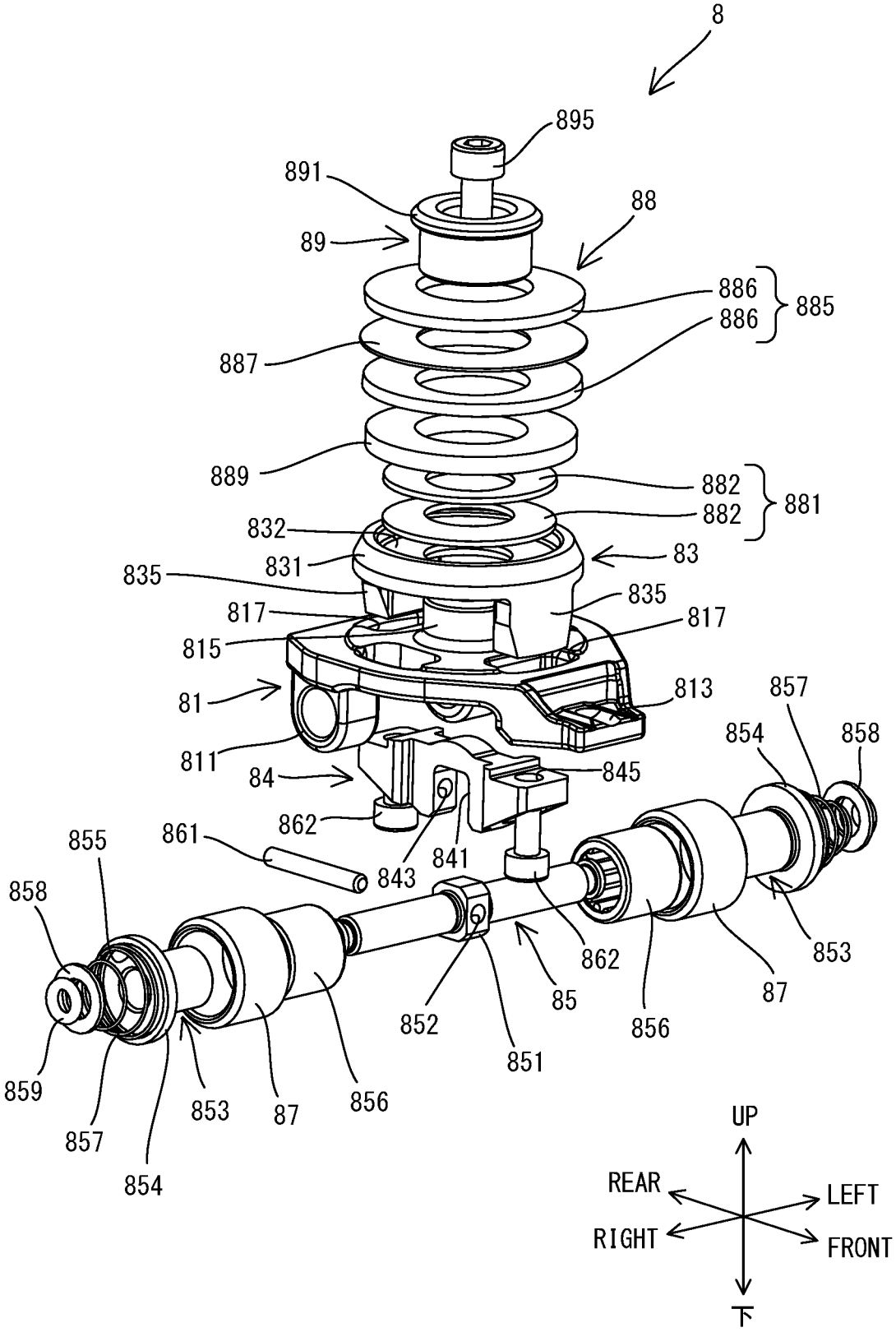
FIG. 8 is an exploded perspective view of the pressing mechanism.

The base member 81 is configured to hold the roller holder 82 such that the roller holder 82 is movable relative to the base member 81. Further, the base member 81 is supported by the body housing 11. As shown in FIGS. 7 and 8, the base member 81 is a plate-like member having a generally triangular shape as a whole when viewed from above, and is arranged such that one of apexes of the triangle is located on its front end. The base member 81 has rotary parts 811, a lever-locking part 813, a cylindrical part 815 and two support holes 817.

The rotary parts 811 are a pair of left and right cylindrical portions provided on the lower side of a rear end portion of the base member 81. The pair of cylindrical portions are coaxially arranged relative to an axis extending in the left-right direction. Although not shown, a pair of support shafts respectively protrude to the right and left from inner surfaces of left and right side portions of the body housing 11. These support shafts are inserted into the rotary parts 811 (the pair of cylindrical parts) from the left and right, so that the base member 81 is pivotably supported relative to the body housing 11.

The lever-locking part 813 is a portion which is formed in a front end portion of the base member 81 which corresponds to one of the three apexes of the triangle, and has a recess recessed downward. This recess is a portion where a locking lever 9 is locked. As shown in FIG. 1, the base member 81 is normally held in the state that the lever-locking part 813 is locked by the locking lever 9 supported by the body housing 11. The locking lever 9 is configured to be pivotable in an upward direction (counterclockwise direction) from the position shown in FIG. 1. In a case where a trouble such as a jam of the driver 3 occurs, a user can eliminate the trouble by turning the locking lever 9 upward and further turning the base member 81 upward.

Figure 9:
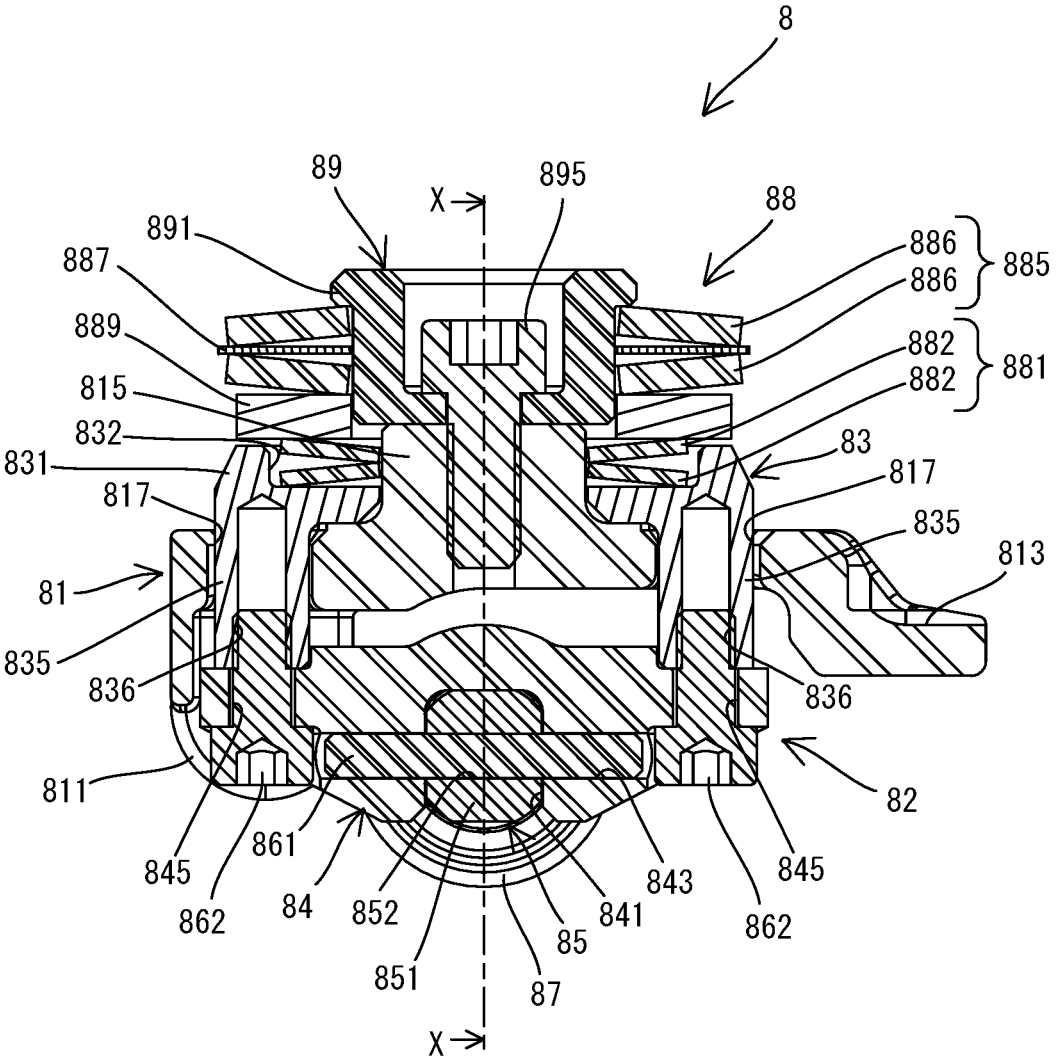
FIG. 9 is a longitudinal sectional view of the pressing mechanism.
Figure 10:
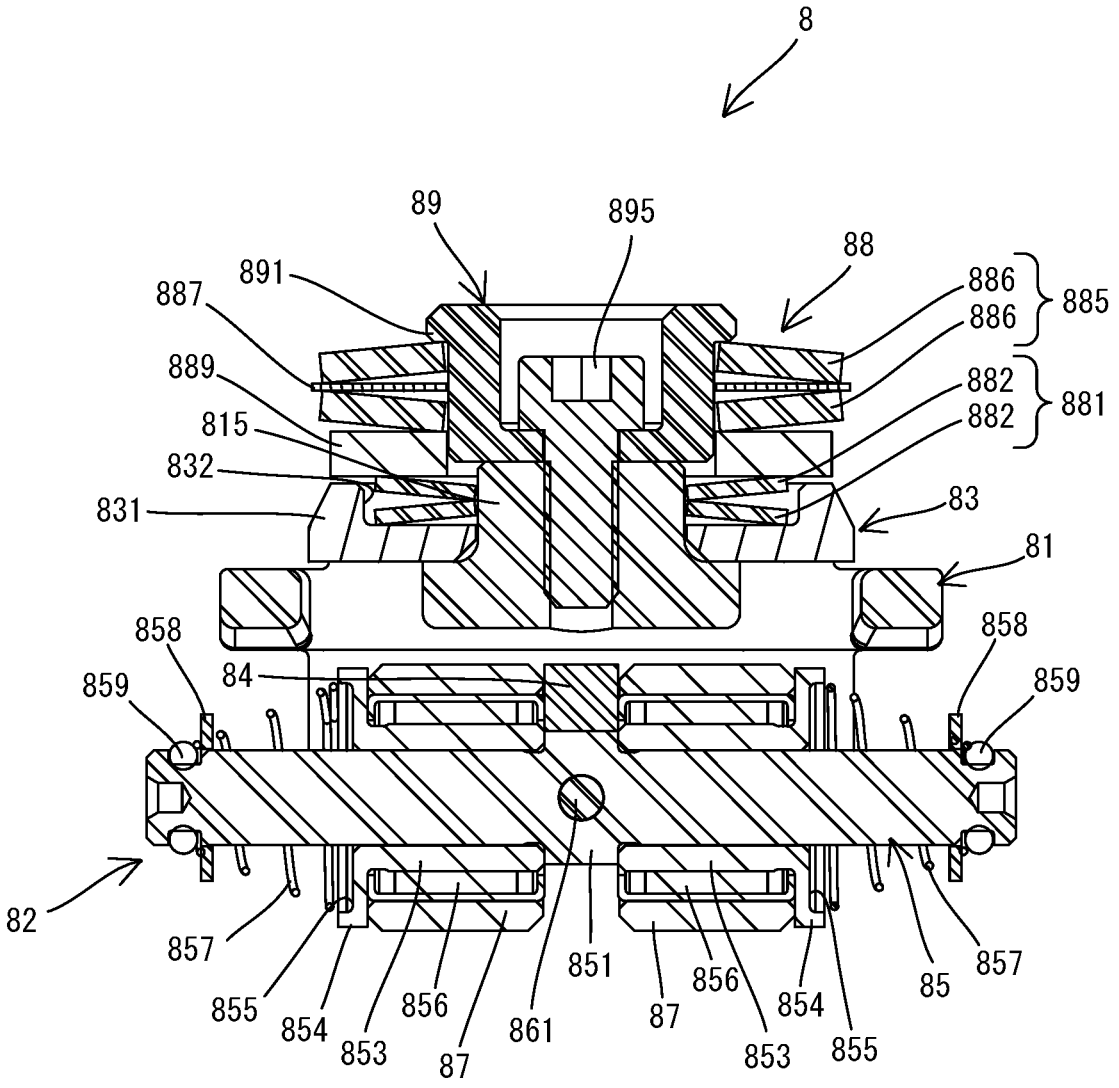
FIG. 10 is a sectional view taken along line X-X in FIG. 9.

As shown in FIGS. 8 to 10, the cylindrical part 815 has a cylindrical shape protruding upward from a central portion of the base member 81. The outer diameter of the cylindrical part 815 is set to be slightly smaller than the inner diameter of disc springs 882 described below. A female thread is formed on an inner peripheral surface of the cylindrical part 815. A spring-holding part 89 is fixed on the upper side of the cylindrical part 815. The spring-holding part 89 is configured as a bottomed cylindrical member. A through hole, through which a screw 895 can be inserted, is formed through a center of a bottom portion (lower end portion) of the spring-holding part 89. The spring-holding part 89 is fixed to the base member 81 by the screw 895 being threadedly engaged with the female thread of the cylindrical part 815 through this through hole. Further, the spring-holding part 89 has a flange part 891 on its upper end portion which protrudes radially outward. The outer diameter of the spring-holding part 89 is set to be slightly smaller than the inner diameter of disc springs 886 described below.

As shown in FIGS. 8 and 9, the support holes 817 are respectively provided on the front and rear sides of the cylindrical part 815. Each of the support holes 817 is a through hole extending through the base member 81 in the up-down direction and has a shape corresponding to a leg part 835 of a frame 83 described below.

The roller holder 82 is a member which is configured to rotatably support the pressing rollers 87 Further, the roller holder 82 is held by the base member 81 so as to be movable in the up-down direction relative to the base member 81. The roller holder 82 is formed by connecting a frame 83, a shaft-holding part 84 and a support shaft 85.

The frame 83 forms an upper portion of the roller holder 82. The frame 83 includes an annular spring-receiving part 831 and the two leg parts 835 protruding downward from the spring-receiving part 831.

The spring-receiving part 831 is mounted onto the cylindrical part 815 of the base member 81 and the two leg parts 835 are respectively inserted through the two support holes 817 of the base member 81, so that the frame 83 is held to be movable in the up-down direction relative to the base member 81. It is noted that a recess 832, which is recessed downward so as to annularly surround the cylindrical part 815, is formed in an upper end surface of the spring-receiving part 831. A threaded hole 836, which extends upward from a lower end of the leg part 835, is formed in each of the leg parts 835.

The shaft-holding part 84 is connected to a lower end portion of the frame 83 in a state in which the shaft-holding part 84 holds the support shaft 85, and forms a lower portion of the roller holder 82. The shaft-holding part 84 has an elongate shape extending in the front-rear direction. The shaft-holding part 84 is formed to have a thickness in the up-down direction which is largest in its central portion and gradually decreases from the central portion toward its front and rear ends. The shaft-holding part 84 has a fitting recess 841, a pin-support hole 843 and a pair of screw-insertion holes 845. The fitting recess 841 is a rectangular recess which is recessed upward from a lower end surface of the shaft-holding part 84, and formed in the central portion of the shaft-holding part 84. The pin-support hole 843 is a through hole extending through the shaft-holding part 84 via the fitting recess 841 in the front-rear direction. The screw-insertion holes 845 are through holes respectively extending in the up-down direction through front and rear end portions of the shaft-holding part 84.

As shown in FIGS. 8 to 10, the support shaft 85 is a shaft for supporting the pressing rollers 87, and extends in the left-right direction while being held by the shaft-holding part 84. The support shaft 85 has a rectangular block-like central part 851. The central part 851 is formed in a shape corresponding to the fitting recess 841 of the shaft-holding part 84, and has a through hole 852 extending through the central part 851 in the front-rear direction. The central part 851 of the support shaft 85 is fitted in the fitting recess 841 and a connecting pin 861 is inserted through the through hole 852 and the pin-support hole 843 of the shaft-holding part 84, so that the support shaft 85 is held by the shaft-holding part 84. Further, two screws 862 are threadedly engaged with the threaded holes 836 of the frame 83 via the screw-insertion holes 845 of the shaft-holding part 84, respectively, so that the shaft-holding part 84 is connected to the frame 83 while holding the support shaft 85.

As shown in FIGS. 8 and 10, the pair of left and right pressing rollers 87 are arranged such that the central part 851 is disposed therebetween, and are rotatably supported by the support shaft 85. More specifically, each of the pressing rollers 87 is supported by the support shaft 85 via a spring-receiving sleeve 853 mounted onto the support shaft 85 and a bearing 856 mounted onto the spring-receiving sleeve 853.

The spring-receiving sleeve 853 is cylindrically shaped and has a flange part 854 protruding radially outward on one axial end portion thereof. The flange part 854 has an outer diameter larger than the outer diameter of the pressing roller 87. The spring-receiving sleeve 853 is mounted onto the support shaft 85 so as to be slidable in the left-right direction, in a state in which the flange part 854 is located on the distal end side of the support shaft 85. An annular recess 855 is formed on an outer surface (on the distal end side of the support shaft 85) of the flange part 854 and recessed inward (toward the central part 851).

One end portion (on a large diameter side) of a coil spring 857 (specifically, a conical coil spring) abuts on the recess 855 of the flange part 854. A washer 858 mounted onto the support shaft 85 abuts on the other end portion (on a small diameter side) of the coil spring 857. An O-ring 859 is fitted in each of annular grooves formed on left and right distal end portions of the support shaft 85. The O-ring 859 prevents the washer 858 from moving outward. The coil spring 857 compressed between the flange part 854 and the washer 858 biases the spring-receiving sleeve 853, the bearing 856 and the pressing roller 87 toward the central part 851 and holds them in a position adjacent to the central part 851.

The spring mechanism 88 is provided to bias the pressing rollers 87 toward the driver 3 in the process in which the driver 3 moves forward from the initial position. As shown in FIGS. 8 to 10, in the present embodiment, the spring mechanism 88 includes a first spring part 881 and a second spring part 885. The first spring part 881 and the second spring part 885 have different spring constants from each other. Further, the first spring part 881 and the second spring part 885 are arranged in series between the roller holder 82 (specifically, the spring-receiving part 831 of the frame 83) and the base member 81 (specifically, the flange part 891 of the spring-holding part 89 fixed to the base member 81). It is noted that an annular stopper 889 is interposed between the first spring part 881 and the second spring part 885.

The first spring part 881 includes two disc springs 882. It is noted that the two disc springs 882 can also be regarded as one spring member. The disc springs 882 are mounted onto the cylindrical part 815 of the base member 81 and disposed in the recess 832 of the spring-receiving part 831. The disc springs 882 are arranged in series such that their inner peripheries abut on each other while their outer peripheries are apart from each other (that is, they are oriented in opposite directions to each other). Therefore, the outer periphery of the lower disc spring 882 of the two disc springs 882 abuts on an upper surface of the spring-receiving part 831, while the outer periphery of the upper disc spring 882 abuts on a lower surface of the stopper 889. The inner diameter of the stopper 889 is set to be slightly larger than the outer diameter of the spring-holding part 89 and substantially equal to the inner diameter of the disc spring 886 described below. Thus, the stopper 889 is mounted onto the spring-holding part 89 so as to be movable in the up-down direction. Further, the outer diameter of the stopper 889 is set to be larger than the outer diameter of the recess 832.

The second spring part 885 includes two disc springs 886. The two disc springs 886 can also be regarded as one spring member. In the present embodiment, a spring constant of the second spring part 885 (that is, the whole of the two disc springs 886) is set to be larger than a spring constant of the first spring part 881 (that is, the whole of the two disc springs 882). Further, the disc spring 886 has a larger diameter than the disc spring 882 of the first spring part 881. The two disc springs 886 are mounted onto the spring-holding part 89 fixed to the cylindrical part 815. The two disc springs 886 are arranged in series with a washer 887 for stabilizing connection therebetween, such that their outer peripheries abut on the washer 887 while their inner peripheries are apart from the washer 887. Therefore, the inner periphery of the lower disc spring 886 of the two disc springs 886 abuts on an upper surface of the stopper 889 and the inner periphery of the upper disc spring 886 abuts on a lower surface of the flange part 891 of the spring-holding part 89.

In the present embodiment, the spring mechanism 88 is disposed between the spring-receiving part 831 of the roller holder 82 and the flange part 891 of the spring-holding part 89 in a slightly loaded (compressed) state. Thus, the base member 81, to which the spring-holding part 89 is fixed, and the roller holder 82 are biased in a direction away from each other by the spring mechanism 88. In other words, the base member 81 is biased upward, while the roller holder 82 is biased downward. Therefore, in a state (initial state) in which an external force of pushing the roller holder 82 upward via the pressing rollers 87 is not applied, as shown in FIGS. 9 and 10, the roller holder 82 is held with a lower surface of the spring-receiving part 831 abutted on an upper surface of the base member 81. Thus, the roller holder 82 and the pressing rollers 87 are prevented from moving downward by the base member 81 and held in a lowest position.

Figure 11:
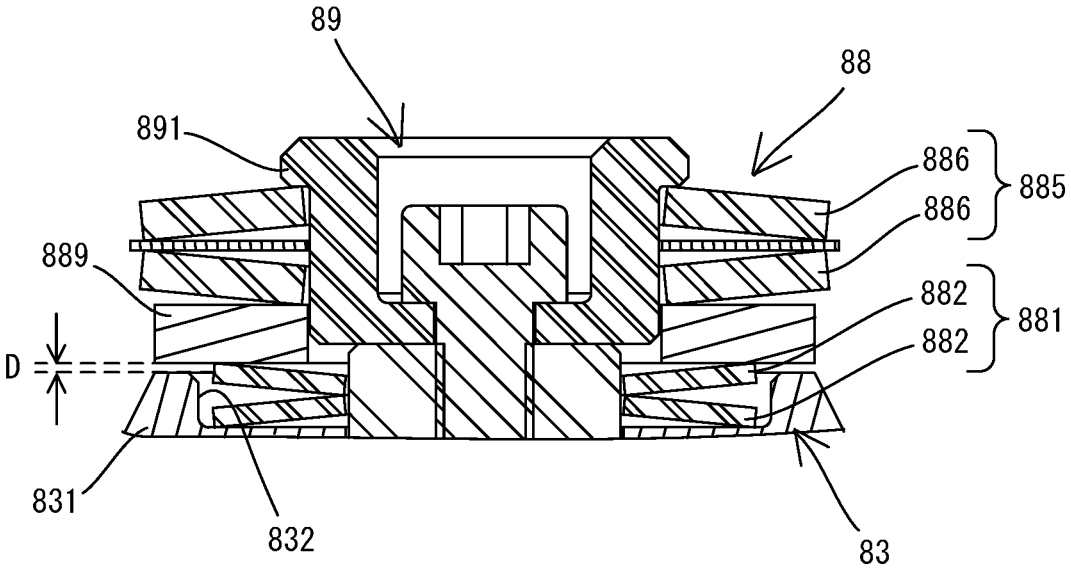
FIG. 11 is a partial, enlarged view of FIG. 9.

As shown in FIG. 11, in the initial state, the upper disc spring 882 of the two disc springs 882 of the first spring part 881 slightly protrudes from an upper end of the recess 832 of the spring-receiving part 831. Therefore, in the initial state, the lower surface of the stopper 889 is spaced upward by a distance D from the upper surface of the spring-receiving part 831. In other words, a clearance exists between the lower surface of the stopper 889 and the upper surface of the spring-receiving part 831 in the up-down direction.

Operation of the nailing machine 1 having the above-described structure is now described.

As described above, in the initial state, the driver 3 is located in the initial position shown in FIGS. 1 and 2. At this time, as shown in FIG. 6, each of the ring members 5 is held by the holding mechanism 6 in the separate position slightly apart from the outer periphery 45 (more specifically, the engagement grooves 47) of the flywheel 40 in the radially outward direction. At this time, each of the pressing rollers 87 is held in the lowest position and in sliding contact with an upper surface of the front end portion of the body part 30 of the driver 3 from above, but not pressing the driver 3 downward. In this state, the ring member 5 is also held in a position apart from the driver 3. More specifically, the ring member 5 is held in a position where the outer-peripheral engagement part 51 is slightly apart downward from the engagement groove 308 of the driver 3.

When the contact arm 125 is pressed against the workpiece 100 and the contact-arm switch (not shown) is switched on in a state in which the driver 3 is in the initial position, the motor 2 is driven and the flywheel 40 starts rotating. In this stage, however, each of the ring members 5 is held in the separate position, thus being incapable of transmitting the rotational energy of the flywheel 40 to the driver 3. Therefore, even if the flywheel 40 rotates, the ring members 5 and the driver 3 do not operate.

Thereafter, when a user depresses the trigger 14 to switch on the trigger switch 141, the solenoid 715 is actuated. Then, the push-out lever 711 turns and the rear end portion of the push-out lever 711 presses the lever-abutting part 305 of the driver 3 forward from the rear. Thus, the driver 3 starts moving forward from the initial position toward the nail-driving position along the operation line L. The driver 3 also moves relative to the ring members 5 held in their respective separate positions.

The pressing rollers 87 abut from the front on the respective abutment surfaces of the inclined parts 302 each having a thickness gradually increasing toward the rear. As the inclined part 302 moves forward, a portion of the outer-peripheral engagement part 51 of each of the ring members 5 enters the engagement groove 308 (see FIG. 3) of the driver 3 and abuts on an open end of the engagement groove 308. With the structure in which the inclined part 307 is formed in a front end portion of the ring-engagement part 306 and the engagement groove 308 has a width in the left-right direction increasing toward its open end, the outer-peripheral engagement part 51 can smoothly enter the engagement groove 308. When the driver 3 moves forward while each of the pressing rollers 87 abuts on the abutment surface of the inclined part 302 and a portion of the outer-peripheral engagement part 51 abuts on the open end of the engagement groove 308, the inclined part 302 functions as a cam and further exhibits a wedge effect. Therefore, each of the ring members 5 is pushed downward from the separate position against the biasing force of the flat spring of the ring-biasing part 60, and each of the pressing rollers 87 held in the lowest position is pushed upward.

In this process, the whole spring mechanism 88 is compressed (displaced). Since the first spring part 881 and the second spring part 885 are connected in series, the spring constant (combined spring constant) of the whole spring mechanism 88 is relatively small. Thus, the rate of increase in load (a biasing force, a spring force) of the spring mechanism 88 which is generated by compression (displacement) of the spring mechanism 88 is also relatively small. Therefore, the pressing rollers 87 softly press the driver 3. Further, in this process, the disc springs 882 of the first spring part 881 which have a smaller spring constant (which are softer) than the disc springs 886 of the second spring part 885 are more strongly compressed, so that the clearance between the upper surface of the spring-receiving part 831 and the lower surface of the stopper 889 becomes narrower.

Figure 12:
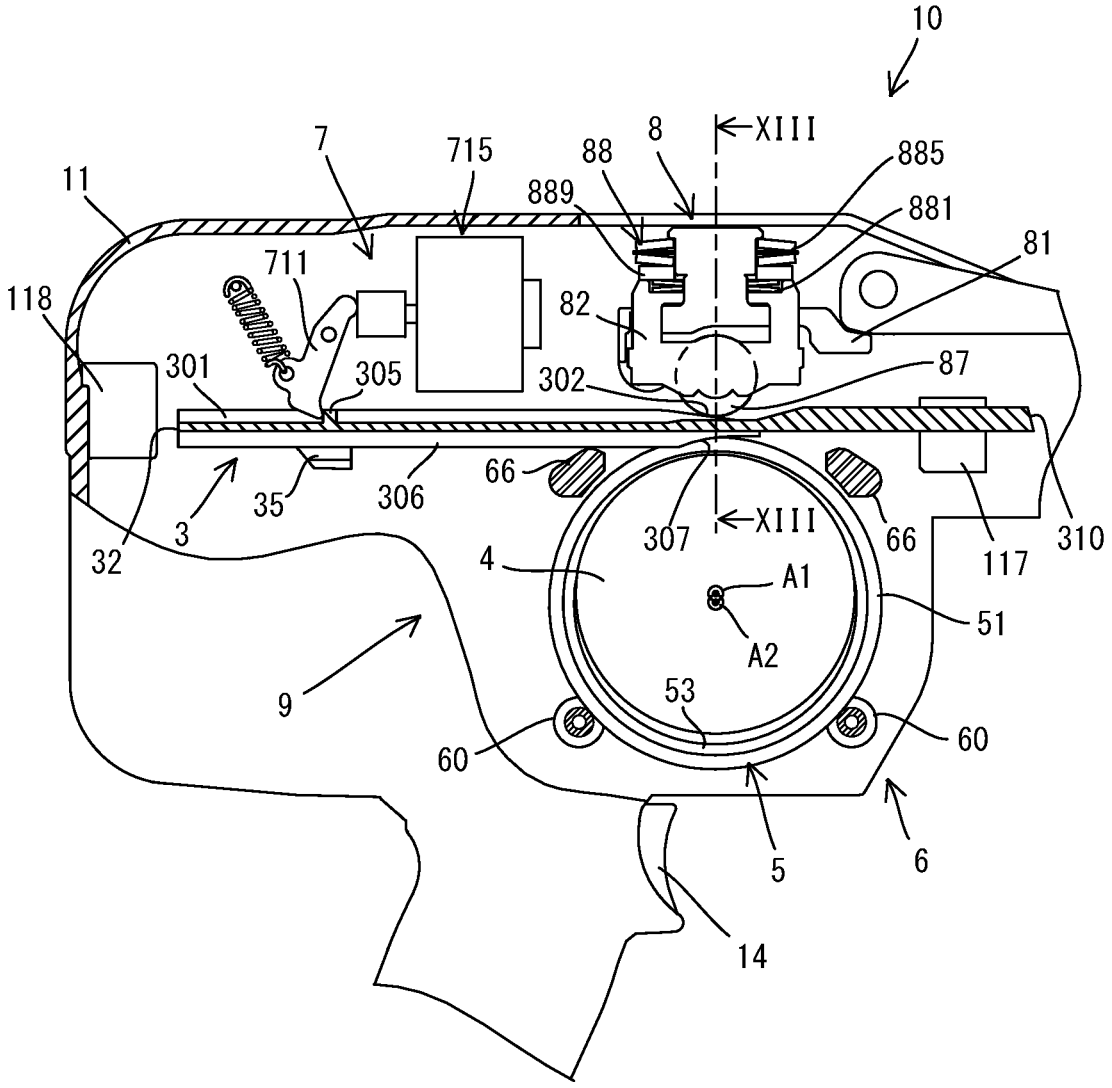
FIG. 12 is an explanatory drawing showing the driver located in a transmitting position and a driver-driving mechanism.
Figure 13:
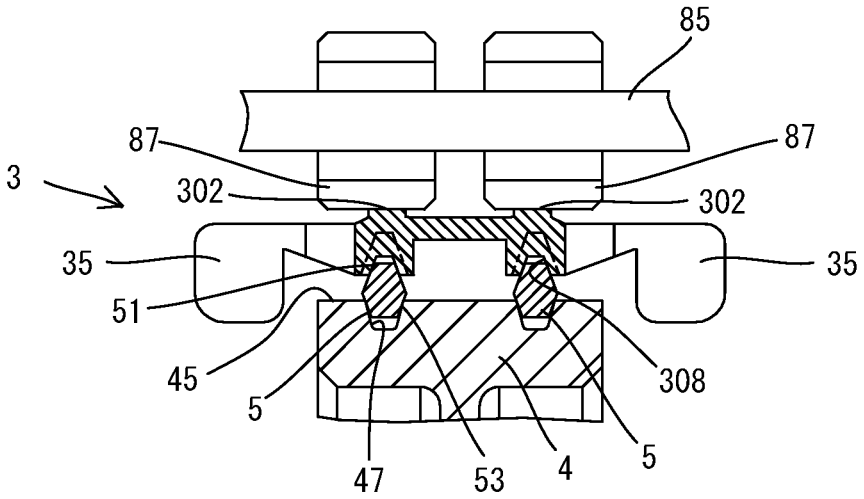
FIG. 13 is a sectional view taken along line XIII-XIII in FIG. 12 (except that, as for the pressing mechanism, only the pressing rollers and the support shaft are shown).

Then, the driver 3 further moves forward and reaches the transmitting position shown in FIG. 12. The transmitting position is a position where transmission of the rotational energy of the flywheel 40 to the driver 3 is enabled. In the present embodiment, when the driver 3 is placed in the transmitting position, each of the pressing rollers 87 is located on the middle of the inclined part 302. As shown in FIG. 13, when the driver 3 is placed in the transmitting position, a portion of the inner-peripheral engagement part 53 of each of the ring members 5 moved downward enters the engagement groove 47 of the flywheel 40 and abuts on an open end of the engagement groove 47, so that the ring member 5 is prevented from further moving downward. At this time, the ring member 5 is rotatably supported in the lowest position by the ring-biasing part 60 while being separated from the stopper 66, and only a portion of the inner-peripheral engagement part 53 abuts on an upper portion of the flywheel 40. In other words, the ring member 5 is held in the contact position by the holding mechanism 6.

Further, the pressing rollers 87 are pushed up by the inclined parts 302, and the ring members 5 are pressed against the flywheel 40 via the driver 3 by the biasing force of the spring mechanism 88. Therefore, a portion of the outer-peripheral engagement part 51 of each of the ring members 5 is frictionally engaged with the driver 3 at the open end of the engagement groove 308 of the driver 3, and a portion of the inner-peripheral engagement part 53 of each of the ring members 5 is frictionally engaged with the flywheel 40 at the open end of the engagement groove 47 of the flywheel 40.

Thus, when each of the ring members 5 is frictionally engaged with the driver 3 and the flywheel 40, the ring member 5 becomes capable of transmitting the rotational energy of the flywheel 40 to the driver 3. It is noted that the "frictionally engaged" state refers to a state that the two members are engaged with each other by frictional force (which state may include a sliding state). The ring member 5 is rotated around a rotation axis A2 by the flywheel 40 while only the portion of the inner-peripheral engagement part 53 of the ring member 5 which is pressed against the flywheel 40 by the driver 3 is frictionally engaged with the flywheel 40.

In the present embodiment, as shown in FIG. 12, the ring member 5 is formed to have a larger diameter than the flywheel 40, and the inner diameter of the ring member 5 is larger than the outer diameter of the flywheel 40 (strictly, the diameter from the rotation axis A1 of the flywheel 40 to the bottom of the engagement groove 47). Therefore, the rotation axis A2 of the ring member 5 is different from the rotation axis A1 of the flywheel 40 and disposed below the rotation axis A1 (further apart from the driver 3). It is noted that the rotation axis A2 extends in parallel to the rotation axis A1. The ring members 5 push out the driver 3, which is frictionally engaged with the ring members 5, forward from the transmitting position shown in FIG. 12.

Figure 14:
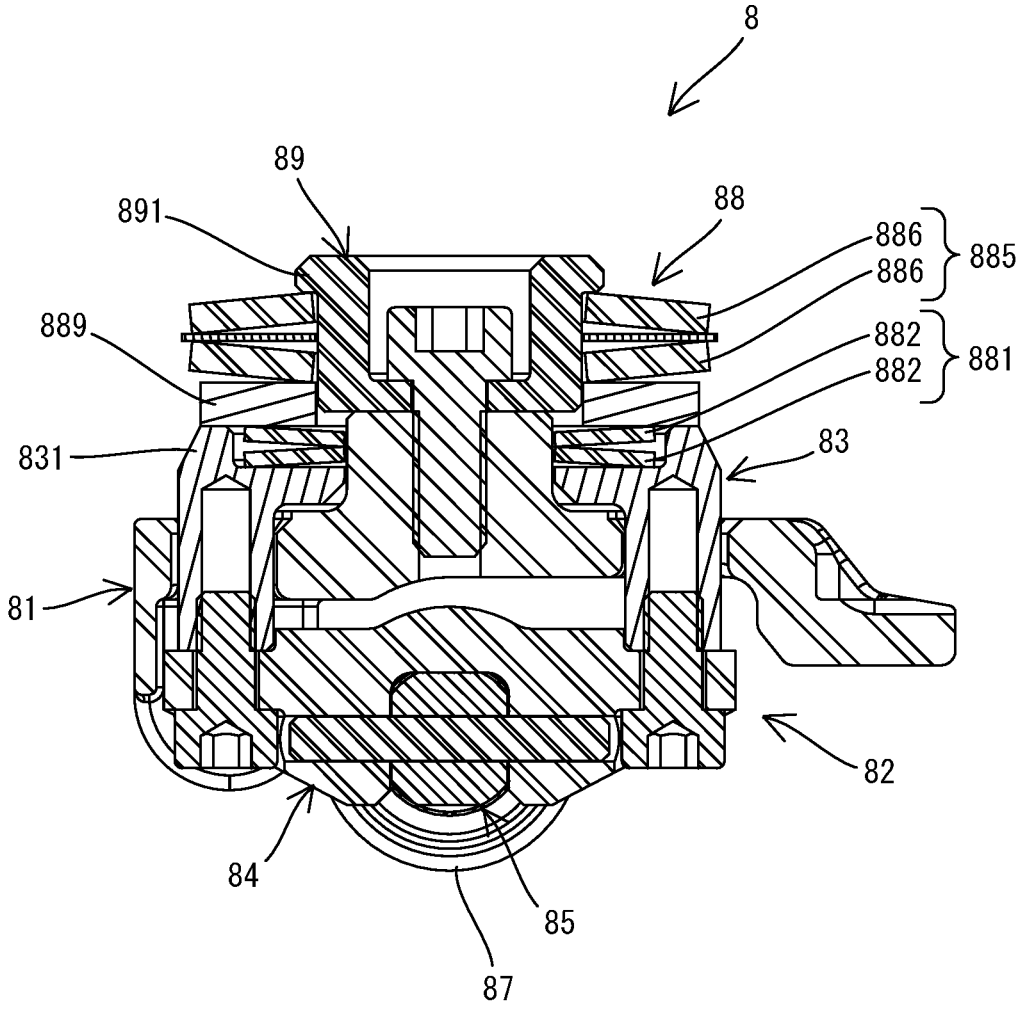
FIG. 14 is a longitudinal sectional view showing the pressing mechanism when the driver is located in the transmitting position.

In the present embodiment, the first spring part 881 is configured such that an amount of displacement (a length to be compressed in the up-down direction, that is, a distance by which the pressing rollers 87 are pushed up by the inclined parts 302) of the whole first spring part 881 (that is, the whole of the two disc springs 882) in the up-down direction is substantially equal to the above-described distance D (see FIG. 11) in the moving process of the driver 3 from the initial position to the transmitting position. Therefore, as shown in FIG. 14, when the driver 3 reaches the transmitting position, the upper surface of the spring-receiving part 831 abuts on the lower surface of the stopper 889, so that the first spring part 881 is prevented from being further compressed and deformed. In other words, the spring-receiving part 831 and the stopper 889 have a function of defining the upper limit of the amount of displacement of the first spring part 881 (a function of preventing displacement beyond the upper limit). Further, the distance D is set such that the spring-receiving part 831 abuts on the stopper 889 before the two disc springs 882 buckle. In other words, the spring-receiving part 831 and the stopper 889 also have a function of preventing buckling of the disc springs 882.

Figure 15:
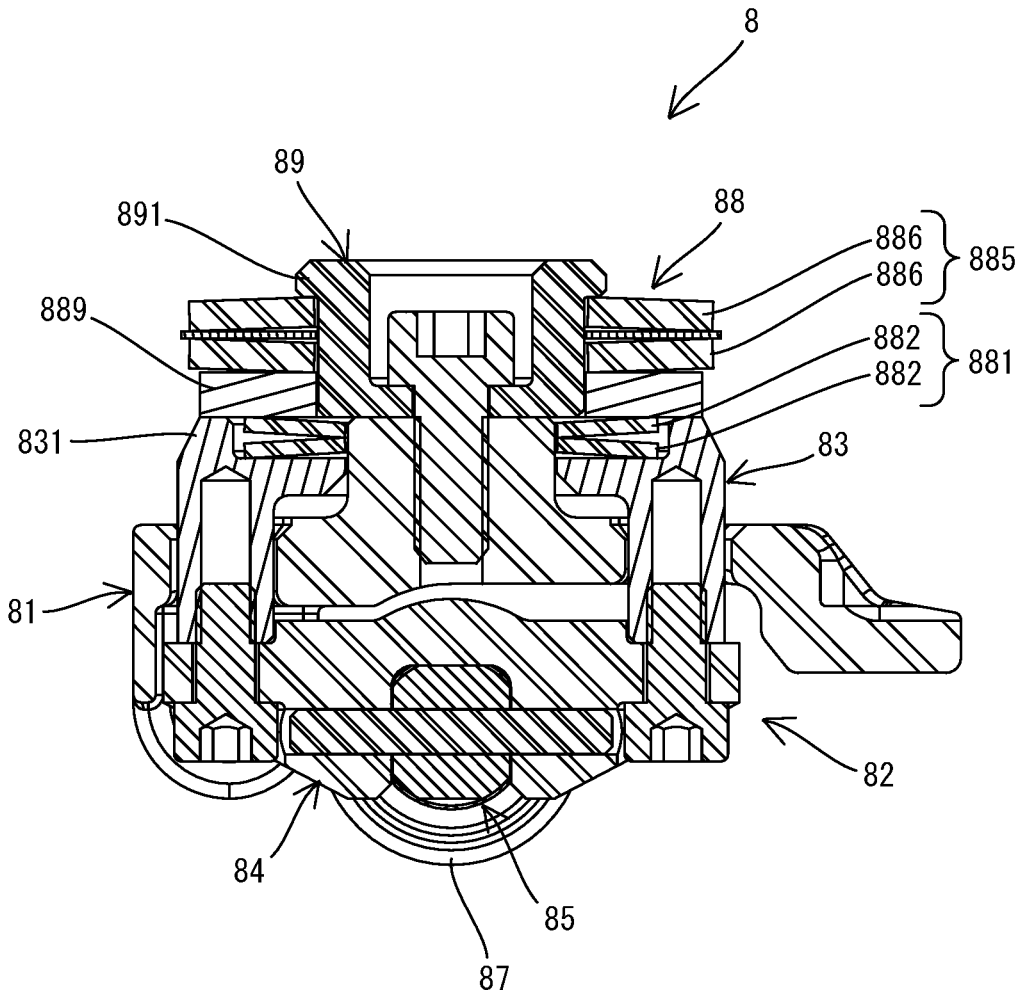
FIG. 15 is a longitudinal sectional view showing the pressing mechanism when the driver is located in a striking position.

The pressing rollers 87 are further pushed up by the inclined parts 302 after the driver 3 is pushed out forward from the transmitting position. As described above, however, the first spring part 881 cannot be further compressed and deformed. As a result, in the moving process of the driver 3 from the transmitting position, the load (biasing force, spring force) of the spring mechanism 88 is defined by the second spring part 885 having a larger spring constant (which is harder). Therefore, the rate of increase in the load relative to the amount of displacement of the spring mechanism 88 (the second spring part 885) becomes higher than the rate of increase in the moving process of the driver 3 from the initial position to the transmitting position. Therefore, as the pressing rollers 87 are pushed up by the inclined parts 302 and the second spring part 885 (the two disc springs 886) is compressed as shown in FIG. 15, the pressing rollers 87 strongly press the driver 3 against the ring members 5 by increased load of the spring mechanism 88. Thus, the frictional engagement between the driver 3 and the portion of the outer-peripheral engagement part 51 and between the flywheel 40 and the portion of the inner-peripheral engagement part 53 gets firmer, so that each of the ring members 5 can transmit the rotational energy of the flywheel 40 to the driver 3 more efficiently.

Figure 16:
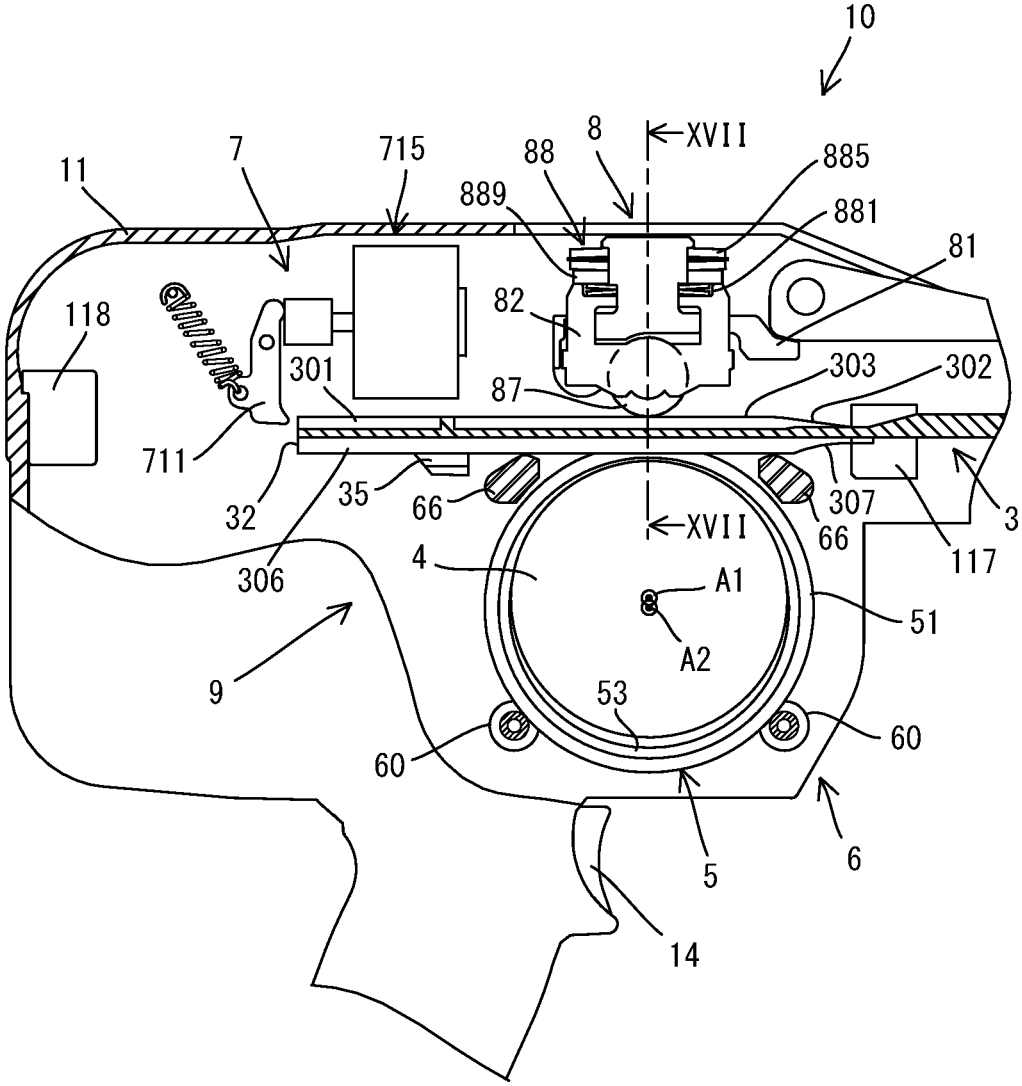
FIG. 16 is an explanatory drawing showing the driver located in the striking position and the driver-driving mechanism.
Figure 17:
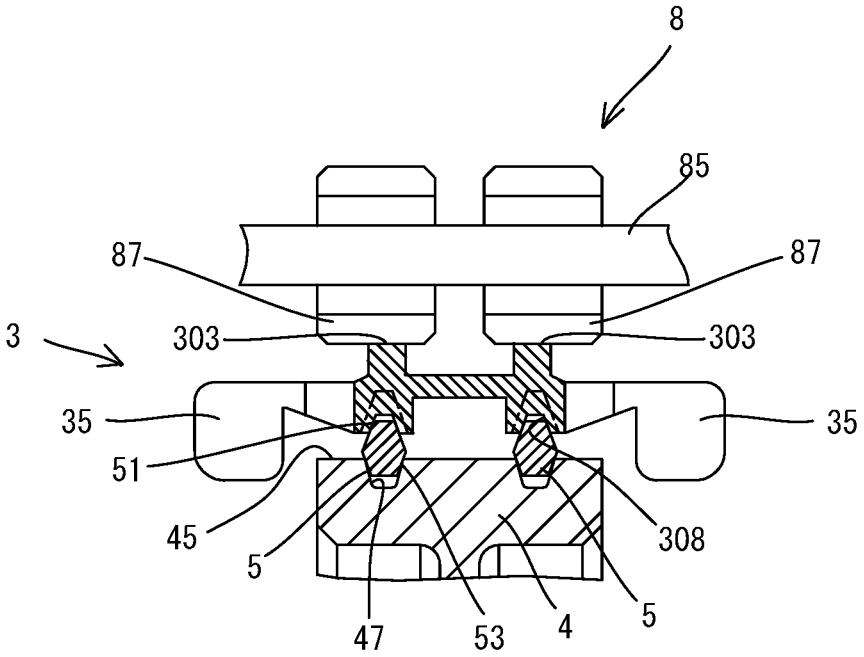
FIG. 17 is a sectional view taken along line XVII-XVII in FIG. 16 (except that, as for the pressing mechanism, only the pressing rollers and the support shaft are shown).

As shown in FIGS. 16 and 17, when the driver 3 further moves forward and the pressing rollers 87 are placed on the straight parts 303 extending rearward from the inclined parts 302, the amount of displacement of the spring mechanism 88 reaches the upper limit and does not further increase. Therefore, the load of the whole spring mechanism 88 also reaches the upper limit and is kept constant. The driver 3 moves forward while being strongly pressed against the ring members 5 by the pressing rollers 87 and thus prevented from sliding, and strikes the nail 101. FIG. 16 shows a state in which the driver 3 is located in a striking position where the driver 3 strikes the nail 101 (see FIG. 1).

The driver 3 further moves to the nail-driving position shown in FIG. 4 and drives the nail 101 into the workpiece 100. The driver 3 is stopped moving when a front ends of the arm parts 35 of the driver 3 respectively abut on the front stopper parts 117 from the rear. When a specified time required for the driver 3 to reach the striking position elapses after the trigger switch 141 is switched on, the controller 18 stops supply of current to the solenoid 715 to thereby return the push-out lever 711 to the initial position. In this state, when the user releases pressing of the contact arm 125 against the workpiece 100 and the contact-arm switch (not shown) is switched off, the controller 18 stops driving of the motor 2. Then, the flywheel 40 stops rotating. Further, the return mechanism (not shown) is actuated to return the driver 3 to the initial position.

Figure 18:
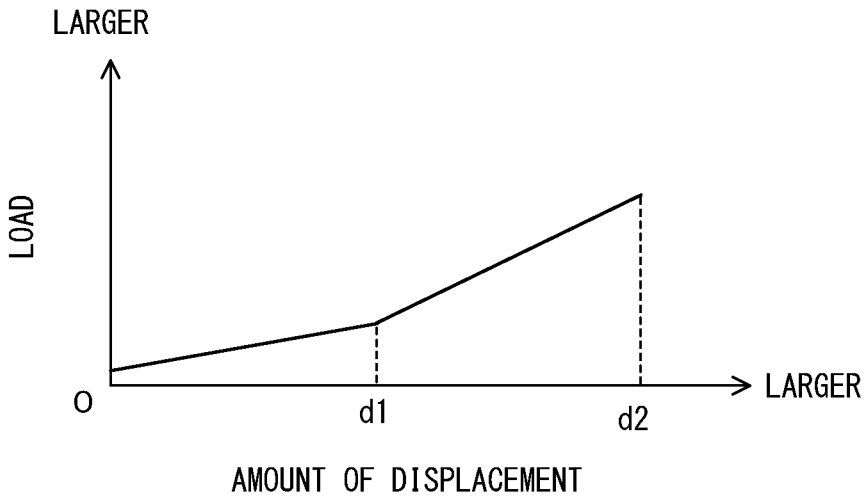
FIG. 18 is a graph for schematically showing the relationship (spring characteristic) between an amount of displacement and load of a spring mechanism.

The relationship (spring characteristic) between the amount of displacement (deflection) of the whole spring mechanism 88 and the load of the whole spring mechanism 88 in the present embodiment is schematically shown in FIG. 18. The amount of displacement d1 in the drawing corresponds to the upper limit (that is, the distance D) of the amount of displacement of the first spring part 881 and the amount of displacement d2 in the drawing corresponds to the upper limit of the amount of displacement of the whole spring mechanism 88. As described above, in a section in which the amount of displacement is from zero to d1, the first spring part 881 and the second spring part 885 are displaced and the spring constant (that is, the rate of increase in the load relative to increase in the amount of displacement) is relatively small. This section corresponds to the moving process of the driver 3 from the initial position to the transmitting position. Further, in a section in which the amount of displacement is from d1 to d2, only the second spring part 885 is displaced and the spring constant becomes larger. This section corresponds to the moving process of the driver 3 from the transmitting position to a front end of the straight part 303. Thus, the spring mechanism 88 of the present embodiment has a nonlinear characteristic (progressive characteristic) that the spring constant of the whole spring mechanism 88 increases as the amount of displacement of the whole spring mechanism 88 increases.

As described above, in the nailing machine 1 of the present embodiment, the pressing mechanism 8 has the spring mechanism 88 including the first spring part 881 and the second spring part 885, and the pressing rollers 87 configured to press the driver 3 by the biasing force of the spring mechanism 88. Further, the spring constant of the whole spring mechanism 88 varies according to the amount of displacement of the whole spring mechanism 88. More specifically, the pressing mechanism 8 is configured such that the spring constant becomes larger when the amount of displacement exceeds a specified limit (the amount of displacement d1, the distance D). With such a structure, in the moving process of the driver 3, the load for the pressing rollers 87 to press the driver 3 can be significantly changed. Thus, in the moving process of the driver 3, the driver 3 can be pressed relatively softly until the driver 3 reaches the transmitting position where the driver 3 becomes frictionally engaged with the ring members 5, and can be pressed relatively strongly thereafter. As a result, the possibility can be reduced that the driver 3 may be flicked when frictionally engaged with the ring members 5 or that the driver 3 may slip when driving the nail 101.

Further, in the spring mechanism 88 of the present embodiment, the first spring part 881 and the second spring part 885 having different spring constants from each other are arranged in series. With this arrangement, the spring mechanism 88 having a nonlinear characteristic can be easily realized.

The pressing mechanism 8 further includes the spring-receiving part 831 and the stopper 889 which are configured to define the upper limit of the amount of displacement of the first spring part 881. In the present embodiment, when the spring mechanism 88 is displaced along with the movement of the driver 3 from the initial position to the transmitting position, displacement of the first spring part 881 having a smaller spring constant (which is softer) than the second spring part 885 is larger than that of the second spring part 885. After the amount of displacement of the first spring part 881 reaches the upper limit d1 (the distance D), only the second spring part 885 having a larger spring constant than the first spring part 881 deforms, so that the rate of increase in the biasing force relative to the amount of displacement becomes higher. By defining the distance D with the stopper 889, switching from the section in which the driver 3 is softly pressed to the section in which the driver 3 is more strongly pressed can be reliably and easily performed in the moving process of the driver 3. Further, the stopper 889 is interposed between the first spring part 881 and the second spring part 885 in a direction in which the first spring part 881 and the second spring part 885 are connected (in the up-down direction) and abuts on an end portion of the first spring part 881 and an end portion of the second spring part 885. Therefore, the first spring part 881 and the second spring part 885 having different diameters from each other can be appropriately connected by utilizing the stopper 889.

In the present embodiment, the first spring part 881 are formed by the two disc springs 882 and the second spring part 885 are formed by the two disc springs 886. A disc spring is capable of generating a large load while saving space. Therefore, the spring mechanism 88 can be realized which effectively prevents the driver 3 from slipping during nail-driving while suppressing increase in the size of the machine.

The above-described embodiment is merely an example, and a driving tool of the present invention is not limited to the structure of the nailing machine 1 of the above-described embodiment. For example, the following modifications may be made. It is noted that only one or a plurality of these modifications may be adopted in combination with the nailing machine 1 of the above-described embodiment or the claimed invention.

The driving tool may be a driving tool which is configured to drive out a fastener other than the nail 101. For example, the driving tool may be embodied as a tacker or a staple gun which is configured to drive out a rivet, a pin or a staple. Further, the driving source of the flywheel 40 is not particularly limited to the motor 2. For example, an AC current motor may be adopted in place of the DC motor.

The shape of the driver 3 and the structure of the driver-driving mechanism 4 which drives the driver 3 may be appropriately changed. For example, the inclined part 302 of the roller-abutting part 301 of the driver 3 may be formed linearly as a whole, or in a gentle circular arc shape at least in part, in a side view. In other words, an upper surface of the inclined part 302 (an abutting surface for the pressing roller 87) may be flat or curved in its entirety, or flat or curved in part. Further, the inclined part 302 may have an inclination which varies halfway. The inclined part 302 may be formed longer, or the roller-abutting part 301 may include a plurality of inclined parts having a thickness gradually increasing toward the rear With such a modification, the manner of pushing the pressing rollers 87 upward in the moving process of the driver 3 (specifically, the manner of displacement of the spring mechanism 88) may change. Therefore, the pressing mechanism 8 may be appropriately changed according to the shape of the driver 3. It may be preferably configured such that the amount of displacement of the spring mechanism 88 increases at least in part of a first process in which the driver 3 moves from the initial position to the transmitting position and at least in part of a second process in which the driver 3 moves from the transmitting position to the striking position. Further, the spring constant of the spring mechanism 88 preferably becomes larger when the amount of displacement exceeds a threshold which is not less than the amount of displacement in the first process.

The structure for holding the spring mechanism 88 in the pressing mechanism 8, the structure for displacing the spring mechanism 88 along with the movement of the driver 3, and the detailed structure of the spring mechanism 88 may be appropriately changed. For example, the structures of the base member 81, the roller holder 82 and the pressing rollers 87 are not limited to those of the present embodiment.

The spring characteristic of the spring mechanism 88 schematically shown in FIG. 18 is merely an illustrative example, and the spring constant (specifically, the gradient of a spring characteristic curve) and the rate of change in the spring constant may be appropriately changed. In other words, the kind and number of springs and a manner of connecting the springs in the spring mechanism 88 may be changed.

For example, each of the first spring part 881 and the second spring part 885 may be formed by a different kind of spring (such as a compression coil spring) from a disc spring. Further, the spring of the first spring part 881 may be different in kind from the spring of the second spring part 885. For example, the first spring part 881 may be formed by a compression coil spring having a smaller spring constant, while the second spring part 885 may be formed by a disc spring having a larger spring constant. The number of springs of each of the first spring part 881 and the second spring part 885 is not particularly limited, and a single or a plurality of springs may be provided. Further, the manner of connecting the springs is not limited to series connection, and may be parallel connection. The stopper 889 and the washer 887 may be omitted.

The spring constants of the first spring part 881 and the second spring part 885 may be the same. In this case, by providing an interposed member, like the stopper 889 of the above-described embodiment, between the first spring part 881 and the second spring part 885 arranged in series, the first spring part 881 may be prevented from being displaced before the spring mechanism 88 is compressed to the maximum extent. With this structure, the first spring part 881 and the second spring part 885 are displaced until the first spring part 881 is prevented from being displaced, and only the second spring part 885 is displaced after the first spring part 881 is prevented from being displaced. The spring constant of only the second spring part 885 is larger than a combined spring constant of the first spring part 881 and the second spring part 885, so that the nonlinear characteristic can also be realized that the spring constant of the whole spring mechanism 88 becomes larger when the amount of displacement of the whole spring mechanism 88 exceeds a specified threshold.

Engagement of the ring members 5 with the driver 3 and the flywheel 40 is not limited to the engagement exemplified in the above-described embodiment. For example, the number of the ring members 5 and the numbers of the engagement grooves 308 of the driver 3 and the engagement grooves 47 of the flywheel 40 which correspond to the ring members 5 may be one or three or more. Further, for example, the shapes, arrangements, numbers and engagement positions of the outer and inner-peripheral engagement parts 51 and 53 and the corresponding engagement grooves 308 and 47 may be appropriately changed. The ring member 5 may be held such that the rotational energy of the flywheel 40 can not be transmitted to the driver 3 when the driver 3 is located in the initial position, and that the ring member 5 starts transmission of the rotational energy when the driver 3 is moved to the transmitting position. Therefore, the structures of the ring-biasing part 60 and the stopper 66 of the holding mechanism 6 may be appropriately changed.

Further, in place of the driver-driving mechanism 4, a driving mechanism may be adopted which is configured to directly press the driver 3 against the flywheel 40 by the pressing mechanism 8 to thereby transmit the rotational energy not via the ring members 5 but directly from the flywheel 40 to the driver 3. Alternatively, the rotational energy of the flywheel 40 may be transmitted to the driver 3 via a transmitting member (such as a roller) which is disposed between the flywheel 40 and the driver 3 and which is other than the ring members 5.

Correspondences between the components of the above-described embodiment and modifications and the components of the present invention are as follows. The nailing machine 1 is an example of the "driving tool" of the present invention. The nail 101 is an example of the "fastener" of the present invention. The tool body 10 and the ejection outlet 123 are examples of the "tool body" and the "ejection outlet", respectively, of the present invention. The flywheel 40 is an example of the "flywheel" of the present invention. The driver 3 is an example of the "driver" of the present invention. The operation line L is an example of the "operation line" of the present invention. The pressing mechanism 8 is an example of the "pressing mechanism" of the present invention. The spring mechanism 88, the first spring part 881 and the second spring part 885 are examples of the "spring mechanism", the "first spring part" and the "second spring part", respectively, of the present invention. The disc spring 882, 886 is an example of the "at least one spring" and the "disc spring". The pressing roller 87 is an example of the "pressing roller" of the present invention. The spring-receiving part 831 and the stopper 889 are an example of the "upper-limit-defining part" of the present invention. The stopper 889 is an example of the "interposed member" of the present invention. The spring-receiving part 831 is an example of the "abutment member" of the present invention.

Further, in view of the nature of the present invention and the above-described embodiment, the following structures (aspects) are provided. Any one or more of the following structures may be adopted in combination with any of the nailing machine 1 of the above-described embodiment, its modifications and the claimed invention.

(Aspect 1)

The spring mechanism may have a nonlinear characteristic that the spring constant becomes larger when the amount of displacement exceeds a specified threshold.

(Aspect 2)

In aspect 1, the first spring part may have a smaller spring constant than the second spring part, and the spring mechanism may be configured such that the first spring part and the second spring part are displaced until the amount of displacement reaches the threshold, and that only the second spring part is displaced after the amount of displacement exceeds the threshold.

(Aspect 3)

The spring mechanism may be configured such that, after the driver reaches a transmitting position where transmission of the rotational energy is enabled, the spring constant of the whole spring mechanism becomes larger than when the driver moves from an initial position to the transmitting position.

(Aspect 4)

The spring mechanism may be configured such that the amount of displacement increases in at least part of a first process in which the driver moves from an initial position to a transmitting position where transmission of the rotational energy is enabled, and in at least part of a second process in which the driver moves from the transmitting position to a striking position where the driver strikes the fastener.

(Aspect 5)

The second spring part may have a larger spring constant than the first spring part, and the at least one spring included in the second spring part may comprise a disc spring.

(Aspect 6)

The pressing mechanism may include an upper-limit-defining part configured to define the amount of displacement of one of the first spring part and the second spring part.

(Aspect 7)

The pressing mechanism may include:

a base member supported by the tool body; and a roller holder configured to rotatably support the pressing roller and held by the base member so as to be movable in the facing direction relative to the base member, and the spring mechanism may be disposed between the base member and the roller holder so as to bias the pressing roller toward the driver.

(Aspect 8)

The driving tool may further comprise:

a ring member configured to transmit the rotational energy of the flywheel to the driver; and an actuating mechanism configured to move the driver forward relative to the ring member from an initial position to a transmitting position where the ring member is capable of transmit the rotational energy to the driver, wherein:

when the driver is in the initial position, the ring member is disposed loosely around the outer periphery of the flywheel, and when the driver is moved to the transmitting position by the actuating mechanism, the driver is pressed against the ring member by the pressing roller, whereby the ring member is frictionally engaged with the driver and the flywheel and rotated around a rotation axis different from a rotation axis of the flywheel by the flywheel, thereby transmitting the rotational energy to the driver.

DESCRIPTION OF NUMERALS

1: nailing machine, 10: tool body, 11: body housing, 117: front stopper part, 118: rear stopper part, 12: nose part, 123: ejection outlet, 125: contact arm, 13: handle, 14: trigger, 141: trigger switch, 15: battery-mounting part, 17: magazine, 18: controller, 19: battery, 2: motor, 21: pulley, 25: belt, 3: driver, 30: body, 301: roller-abutting part, 302: inclined part, 303: straight part 305: lever-abutting part, 306: ring-engagement part, 307: inclined part, 308: engagement groove, 31: striking part, 310: front end, 32: rear end, 35: arm part, 4: driver-driving mechanism, 40: flywheel 41: pulley, 45: outer periphery, 47: engagement groove, 5: ring member, 51: outer-peripheral engagement part, 53: inner-peripheral engagement part, 6: holding mechanism, 60: ring-biasing part, 66: stopper, 7: actuating mechanism, 711: push-out lever, 715: solenoid, 8: pressing mechanism, 81: base member, 811: rotary part, 813: lever-locking part, 815: cylindrical part, 817: support hole, 82: roller holder, 83: frame, 831: spring-receiving part, 832: recess, 835: leg part, 836: threaded hole, 84: shaft-holding part, 841: fitting recess, 843: pin-support hole, 845: screw-insertion hole, 85: support shaft, 851: central part, 852: through hole, 853: spring-receiving sleeve, 854: flange part, 855: recess, 856: bearing, 857: spring member, 858: washer, 859: O-ring, 861: connecting pin, 862: screw, 87: pressing roller, 88: spring mechanism, 881: first spring part, 882: disc spring, 885: second spring part, 886: disc spring, 887: washer, 889: stopper, 89: spring-holding part, 891: flange part, 895: screw, 9: locking lever, 100: workpiece, 101: nail, A1: rotation axis, A2: rotation axis, L: operation line

The invention claimed is:

1. A driving tool configured to eject a fastener from an ejection outlet to drive the fastener into a workpiece, the driving tool comprising:

a tool body extending in a front-rear direction of the driving tool and having the ejection outlet on a front end of the tool body;

a flywheel housed in the tool body and configured to be rotationally driven;

a driver that faces an outer periphery of the flywheel and is configured to linearly move forward along an operation line extending in the front-rear direction by rotational energy transmitted from the flywheel to thereby strike and drive the fastener into the workpiece; and a pressing mechanism on a side opposite to the flywheel across the driver in a facing direction in which the flywheel and the driver face each other, wherein:

the pressing mechanism comprises:

a spring mechanism including a first spring part and a second spring part and configured to be displaced along with forward movement of the driver, the first spring part including at least one spring, the second spring part including at least one spring; and a pressing roller that faces the driver and is configured to press the driver toward the flywheel in the facing direction by a biasing force of the spring mechanism in a process of the forward movement of the driver, to thereby enable transmission of the rotational energy to the driver;

a spring constant of an entirety of the spring mechanism varies according to an amount of displacement of the entirety of the spring mechanism; and the spring mechanism has a nonlinear characteristic that the spring constant becomes larger when the amount of displacement exceeds a specified threshold.

2. The driving tool as defined in claim 1, wherein the first spring part and the second spring part are arranged in series.

3. The driving tool as defined in claim 2, wherein:

the first spring part and the second spring part have different spring constants from each other.

4. The driving tool as defined in claim 3, wherein the pressing mechanism includes an upper-limit-defining part configured to define an amount of displacement of one of the first spring part and the second spring part.

5. The driving tool as defined in claim 4, wherein:

the second spring part has a larger spring constant than the first spring part, and the upper-limit-defining part is configured to define the amount of displacement of the first spring part.

6. The driving tool as defined in claim 5, wherein the upper-limit-defining part includes:

an interposed member between the first spring part and the second spring part and abutting on an end portion of the first spring part and an end portion of the second spring part, and an abutment member configured to abut on the interposed member to thereby define the amount of displacement of the first spring part.

7. The driving tool as defined in claim 6, wherein the at least one spring of the first spring part and the at least one spring of the second spring part each comprise a disc spring.

8. The driving tool as defined in claim 1, wherein:

the second spring part has a larger spring constant than the first spring part, and the at least one spring included in the second spring part comprises a disc spring.

9. The driving tool as defined in claim 1, wherein the at least one spring of the first spring part and the at least one spring of the second spring part each comprise a disc spring.

10. The driving tool as defined in claim 1, wherein:

the first spring part has a smaller spring constant than the second spring part, and the spring mechanism is configured such that the first spring part and the second spring part are displaced until the amount of displacement reaches the threshold, and that only the second spring part is displaced after the amount of displacement exceeds the threshold.

11. The driving tool as defined in claim 1, wherein the spring mechanism is configured such that the amount of displacement increases in at least part of a first process in which the driver moves from an initial position to a transmitting position where transmission of the rotational energy is enabled, and in at least part of a second process in which the driver moves from the transmitting position to a striking position where the driver strikes the fastener.

12. The driving tool as defined in claim 1, wherein:

the pressing mechanism includes:

a base member supported by the tool body; and a roller holder configured to rotatably support the pressing roller and held by the base member so as to be movable in the facing direction relative to the base member, and the spring mechanism is between the base member and the roller holder and biases the pressing roller toward the driver.

13. The driving tool as defined in claim 1, further comprising:

a ring member configured to transmit the rotational energy of the flywheel to the driver; and an actuating mechanism configured to move the driver forward relative to the ring member from an initial position to a transmitting position where the ring member is capable of transmitting the rotational energy to the driver, wherein the driver, the ring member and the flywheel are configured such that:

when the driver is in the initial position, the ring member is loosely around the outer periphery of the flywheel, and when the driver is moved to the transmitting position by the actuating mechanism, the driver is pressed against the ring member by the pressing roller, whereby the ring member is frictionally engaged with the driver and the flywheel and rotated around a rotation axis different from a rotation axis of the flywheel by the flywheel, thereby transmitting the rotational energy to the driver.

14. A driving tool configured to eject a fastener from an ejection outlet to drive the fastener into a workpiece, the driving tool comprising:

a tool body extending in a front-rear direction of the driving tool and having the ejection outlet on a front end of the tool body;

a flywheel housed in the tool body and configured to be rotationally driven;

a driver that faces an outer periphery of the flywheel and is configured to linearly move forward along an operation line extending in the front-rear direction by rotational energy transmitted from the flywheel to thereby strike and drive the fastener into the workpiece; and a pressing mechanism on a side opposite to the flywheel across the driver in a facing direction in which the flywheel and the driver face each other, wherein:

the pressing mechanism comprises:

a spring mechanism including a first spring part and a second spring part and configured to be displaced along with forward movement of the driver, the first spring part including at least one spring, the second spring part including at least one spring; and a pressing roller that faces the driver and is configured to press the driver toward the flywheel in the facing direction by a biasing force of the spring mechanism in a process of the forward movement of the driver, to thereby enable transmission of the rotational energy to the driver;

a spring constant of an entirety of the spring mechanism varies according to an amount of displacement of the entirety of the spring mechanism; and the first spring part and the second spring part have different spring constants from each other.

15. The driving tool as defined in claim 14, wherein the pressing mechanism includes an interposed member between the first spring part and the second spring part and abutting on an end portion of the first spring part and an end portion of the second spring part.

16. The driving tool as defined in claim 14, wherein the pressing mechanism includes an upper-limit-defining part configured to define an amount of displacement of one of the first spring part and the second spring part.

17. The driving tool as defined in claim 16, wherein:

the second spring part has a larger spring constant than the first spring part, and the upper-limit-defining part is configured to define the amount of displacement of the first spring part.

18. The driving tool as defined in claim 17, wherein the upper-limit-defining part includes:

an interposed member between the first spring part and the second spring part and abutting on an end portion of the first spring part and an end portion of the second spring part, and an abutment member configured to abut on the interposed member to thereby define the amount of displacement of the first spring part.

19. A driving tool configured to eject a fastener from an ejection outlet to drive the fastener into a workpiece, the driving tool comprising:

a tool body extending in a front-rear direction of the driving tool and having the ejection outlet on a front end of the tool body;

a flywheel housed in the tool body and configured to be rotationally driven;

a driver that faces an outer periphery of the flywheel and is configured to linearly move forward along an operation line extending in the front-rear direction by rotational energy transmitted from the flywheel to thereby strike and drive the fastener into the workpiece; and a pressing mechanism on a side opposite to the flywheel across the driver in a facing direction in which the flywheel and the driver face each other, wherein:

the pressing mechanism comprises:

a spring mechanism including a first spring part and a second spring part and configured to be displaced along with forward movement of the driver, the first spring part including at least one spring, the second spring part including at least one spring; and a pressing roller that faces the driver and is configured to press the driver toward the flywheel in the facing direction by a biasing force of the spring mechanism in a process of the forward movement of the driver, to thereby enable transmission of the rotational energy to the driver;

a spring constant of an entirety of the spring mechanism varies according to an amount of displacement of the entirety of the spring mechanism; and the spring mechanism is configured such that, after the driver reaches a transmitting position in which the transmission of the rotational energy to the driver is enabled, the spring constant of the whole spring mechanism becomes larger than when the driver moves from an initial position to the transmitting position.

* * * * *